US007808440B2

(12) United States Patent
Iizuka et al.

(10) Patent No.: US 7,808,440 B2
(45) Date of Patent: Oct. 5, 2010

(54) MULTIPLE-RESONANCE ANTENNA

(75) Inventors: Hideo Iizuka, Nissin (JP); Nobuhiro Ide, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 243 days.

(21) Appl. No.: 12/184,678

(22) Filed: Aug. 1, 2008

(65) Prior Publication Data

US 2009/0040124 A1 Feb. 12, 2009

(30) Foreign Application Priority Data

Aug. 3, 2007 (JP) ..... 2007-203400
Dec. 4, 2007 (JP) ..... 2007-313967

(51) Int. Cl.
*H01Q 9/16* (2006.01)

(52) U.S. Cl. ..... 343/802; 343/793

(58) Field of Classification Search ..... 343/793, 343/795, 802, 803, 810, 812
See application file for complete search history.

(56) References Cited

U.S. PATENT DOCUMENTS 3,277,487 A * 10/1966 Berry et al. ..... 343/722
6,965,353 B2 * 11/2005 Shirosaka et al. ..... 343/802
7,265,730 B2 * 9/2007 Iizuka et al. ..... 343/802

FOREIGN PATENT DOCUMENTS

JP 2006-135605 A 5/2006
JP 2006-295873 10/2006
JP 2006-333429 12/2006

OTHER PUBLICATIONS

Lei Liu, et al., "Dominant mode leaky-wave antenna with backfire-to-endfire scanning capability", Electronic Letters, vol. 38, No. 23, Nov. 7, 2002, 2 Pages.
Martin Schüßler, et al., "Design of Compact Planar Antennas using LH-Transmission Lines", IEEE MTT-S Int. Microwave Symp. Dig., vol. 1, 2004, pp. 209-212.

(Continued)

*Primary Examiner*—Shih-Chao Chen
(74) *Attorney, Agent, or Firm*—Oblon, Spivak, McClelland, Maier & Neustadt, L.L.P.

(57) ABSTRACT

A dipole antenna includes a plurality of parallel metal wires as its basic structure, and a plurality of identical or similar unit circuits arranged in a row in an extending direction of the plurality of metal wires and connected with each other. The unit circuits each have a tie portion that connects the metal wires with each other via at least one first inductor, and at least one first capacitor provided on at least one of the metal wires. The plurality of metal wires each have a base portion and an extended portion, and the plurality of metal wires are each bent such that the extended portion extends at an angle of 90 degrees with respect to the base portion.

19 Claims, 23 Drawing Sheets

OTHER PUBLICATIONS

Chen-Jung Lee, et al., "Design of Resonant Small Antenna Using Composite Right/Left-Handed Transmission Line", IEEE Int. Antennas Propagat. Symp. Dig., vol. 2B, Jul. 2005, 4 Pages.

Fahad Qureshi, et al., "A Compact and Low-Profile Metamaterial Ring Antenna With Vertical Polarization", IEEE Antennas and Wireless Propagation Letters, vol. 4, 2005, pp. 333-336.

S. Otto, et al., "Composite Right/Left-Handed λ-Resonator Ring Antenna for Dual-Frequency Operation", IEEE Int. Antennas Propagat. Symp. Dig., vol. 1A, Jul. 2005, 4 Pages.

R. A. Shelby, et al., "Experimental Verification of a Negative Index of Refraction", Science, vol. 292, Apr. 6, 2001, pp. 77-79.

* cited by examiner n=-1,315 MHz, zx plane.

n=-1,315 MHz, xy plane.

n=−3,436 MHz, zx plane.

n=−3,436 MHz, xy plane.

335MHz

407MHz

451MHz

335 MHz, yz plane.

335 MHz, xy plane.

451 MHz, yz plane.

451 MHz, xy plane.

MULTIPLE-RESONANCE ANTENNA

INCORPORATION BY REFERENCE

The disclosures of Japanese Patent Application No. 2007-313967 filed on Dec. 4, 2007 and Japanese Patent Application No. 2007-203400 filed on Aug. 3, 2007 including the specifications, drawings and abstracts are incorporated herein by reference in their entirety.

BACKGROUND OF THE INVENTION

1. Field of the Invention

The present invention relates to a small multiple-resonance antenna, more specifically a dipole antenna and an inverted-L antenna that includes a plurality of parallel metal wires as its basic structure and a plurality of identical or similar unit circuits arranged in a row in the direction of the metal wires and connected with each other.

2. Description of the Related Art

As stated in R. A. Shelby, D. R. Smith, and S. Schults, "Experimental verification of a negative index of refraction", Science, vol. 292, pp. 77-79, April 2001, left-handed materials have been studied and applied to antennas vigorously since their appearance. The term "left-handed material" refers to a material having both a negative permittivity and a negative magnetic permeability. When an electromagnetic wave is propagated in the left-handed material, its group velocity and phase velocity of the electromagnetic wave are opposite in direction. The left-handed material also shortens the wavelength of the electromagnetic wave as its frequency decreases.

Examples of antennas that operate as a left-handed antenna include: a leaky wave antenna disclosed in L. Liu, C. Caloz, and T. Ito, "Dominant mode Leaky-wave antenna with backfire-to-endfire scanning capability", Electron. Lett., vol. 38, no. 23, pp. 1414-1416, November 2002; a small antenna formed on a ground disclosed in M. Schuessler, J. Freese, and R. Jakoby, "Design of compact planar anarantennas using LH-transmission lines", 2004 IEEE MTT-S Int. Microwave Symp. Dig., vol. 1, pp. 209-212, Fort Worth, Tex., June 2004, C. J. Lee, K. M. H. Leong, and T. Itoh, "Design of resonant small antenna using composite right/left-handed transmission line", IEEE Int. Antennas Propagat. Symp. Dig., vol. 2B, pp. 218-221, Washington D.C., July 2005, and F. Qureshi, M. A. Antoniades, and G. V. Eleftheriades, "A compact and low-profile metamaterial ring antenna with vertical polarization", IEEE Antennas and Wireless Propagat. Lett., vol. 4, pp. 333-336, 2005; and a dipole antenna disclosed in Japanese Patent Application Publication No. 2006-295873 (JP-A-2006-295873).

FIG. 21 shows a straight dipole antenna A10 that operates as a left-handed antenna disclosed in JP-A-2006-295873. The dipole antenna A10 includes two parallel metal wires p10, q10 as its basic structure, and six unit circuits U10 having length a and connected in the x-axis direction (the direction of the metal wires p10, q10). The unit circuits U10 are each composed of two capacitors CSE10 connected in series on a part of the metal wire p10, and a tie portion that ties the metal wires p10 and q10 via an inductor LSH10. A feed point F constituted of two points FL, FR is positioned at the middle of the metal wire p10.

With the capacitors CSE10 and the inductors LSH10 arranged periodically, the dipole antenna A10 may operate as a left-handed antenna. As described above, the left-handed material reduces the wavelength shorter as the frequency decreases. Therefore, the antenna length L10 of the dipole antenna A10 may be reduced to about one tenth the operating wavelength by controlling the capacitance of the capacitor CSE10 and the inductance of the inductor LSH10.

A dual-resonance antenna that operates with a right-handed material and a left-handed material is disclosed in S. Otto, A. Rennings, C. Caloz, P. Waldow, and T. Itoh, "Composite Right/Left-Handed λ-Resonator Ring Antenna for Dual-Frequency Operation", IEEE Int. Antennas Propagat. Symp. Dig., vol. 1A, pp. 684-687, Washington D.C., July 2005.

The frequency band of electromagnetic waves allocated to tire air pressure warning systems and smart entry systems, which are in-vehicle applications, is the 400 MHz band in Europe, and the 300 MHz band in North America and Japan. Antennas for use used in these systems are preferably small, because their installation space is occasionally limited, and can able to use both the two frequency bands, namely the 300 MHz band and the 400 MHz band, because their installation space is occasionally limited.

In normal right-handed antennas, if a first resonance occurs at 300 MHz, for example, a second resonance occurs at about 900 MHz, about three times the frequency of the first resonance. The dipole length is equivalent to half the operating wavelength for the first resonance, and 1.5 times the operating wavelength for the second resonance. Since there is a wide gap between the frequencies of the first and second resonances as described above, right-handed antennas cannot be used for the applications mentioned above.

In contrast, in left-handed antennas, decreases in frequency shorten the wavelength and reduce the gap between the frequencies. That is, a first resonance may occur at about 400 MHz (half the wavelength), and a second resonance may occur at about 300 MHz (1.5 times the wavelength). When the antenna length is short relative to the operating wavelength, however, the dipole antenna A10 in accordance with the above related art does not operate as an antenna, because currents flow in opposite directions to cancel each other at the second resonance.

With the dual-resonance antenna that operates as a left-handed antenna and a right-handed antenna disclosed in IEEE Int. Antennas Propagat. Symp. Dig., vol. 1A, pp. 684-687, Washington D.C., July 2005, the gap between the resonance frequencies cannot be reduced. In addition, it is necessary to improve the radiation efficiency by impedance matching at the feed point.

SUMMARY OF THE INVENTION

The present invention provide a small multiple-resonance antenna that resonates at narrowly gapped frequencies and that may be easily subjected to impedance matching at the feed point.

A first aspect of the present invention is directed to a dipole antenna including a plurality of parallel metal wires. In the dipole antenna, the plurality of metal wires have a plurality of identical or similar unit circuits arranged in a row in an extending direction of the metal wires and connected with each other; the unit circuits each have a tie portion that connects the metal wires with each other via at least one first inductor, and at least one first capacitor provided on at least one of the metal wires; and the plurality of metal wires each have a base portion and an extended portion, and the plurality of metal wires are each bent such that the extended portion extends at an angle of 90 degrees with respect to the base portion.

According to the above configuration, the dipole antenna may operate as a left-handed antenna due to the configuration in which the unit circuits constituted of the first capacitor and the first inductor are arranged periodically. Due to the structure in which the metal wires are bent to obtain symmetry with respect to a line, the current components in the base portion, which extends in the direction perpendicular to the extended portions, contain no components in the opposite direction. As a result, multiple-resonance characteristics may be obtained. In addition, a small antenna that operates as a left-handed antenna and with narrowly gapped resonance frequencies may be realized.

In the dipole antenna in accordance with this aspect, a pair of the extended portions may be provided, and the extended portions may be symmetric with respect to a symmetry axis perpendicular to each of the plurality of metal wires forming the base portion and passing through a middle portion, in the extending direction of the metal wires, of each of the plurality of metal wires forming the base portion. According to the above configuration, due to the structure in which the metal wires are bent to obtain symmetry with respect to a line, the current components in the extended portions may be in opposite directions to each other and hence canceled by each other.

In the dipole antenna in accordance with this aspect, a continuing body composed of the base portion and the extended portions may form a squared U-shape.

In the dipole antenna in accordance with this aspect, the symmetry axis may be perpendicular to a plane in which the plurality of metal wires composing the base portion are disposed. According to the above configuration, the planes composed of the plurality of metal wires are composed of the base portion and the extended portion bent at an angle of 90 degrees.

In the dipole antenna in accordance with this aspect, the symmetry axis may be positioned in a plane in which the plurality of metal wires composing the base portion are disposed. According to the above configuration, the plurality of metal wires are each bent at an angle of 90 degrees within the plane defined by the plurality of metal wires to form the base portion and the extended portion.

In the dipole antenna in accordance with this aspect, the base portion may be provided on a ground conductor and the extended portion may be disposed parallel to the ground conductor. According to the above configuration, an inverted-L antenna is provided on the ground conductor. In this antenna, a pair of upper and lower base portions perpendicular to the ground conductor and a pair of parallel extended portions parallel to the ground conductor are formed by the base portion and the extended portion provided on the ground conductor and their mirror images with the ground conductor as a mirror surface. Since half of the symmetric antenna is formed as a mirror image with the ground conductor as a mirror surface, the size of the antenna may be reduced to about half that of conventional dipole antennas.

The dipole antenna in accordance with this aspect may further include a connection line constituted of at least one of the plurality of unit circuits, disposed parallel to the base portion and connected to the extended portion. According to the above configuration, the connection line is composed of unit circuits similar to those of the base portion and the extended portion. The connection line is provided parallel to the base portion and on the side of the distal end of the extended portion with respect to the base portion. Since the connection line is disposed parallel to the base portion and connected to the extended portion, the impedance of the antenna side at the feed point is increased, which allows impedance matching at the feed point. As a result, the power efficiency is improved.

In the dipole antenna in accordance with this aspect, the base portion and the connection line may be provided on a ground conductor; and the extended portion may be disposed parallel to the ground conductor. According to the above configuration, an inverted-F antenna is provided on the ground conductor. In this antenna, which has a connection line, a pair of upper and lower base portions and a pair of upper and lower connection lines perpendicular to the ground conductor and a pair of parallel extended portions parallel to the ground conductor are formed by the base portion, the connection line, and the extended portion provided on the ground conductor and their mirror images with the ground conductor as a mirror surface.

In the dipole antenna in accordance with this aspect, a feed point of the dipole antenna may be provided in the base portion or at the connection line.

In the dipole antenna in accordance with this aspect, a ratio in length between the base portion and the extended portion may be 1:n, where n is a positive integer. According to the above configuration, a dipole antenna having (n+1)-resonance characteristics may be realized.

In the dipole antenna in accordance with this aspect, the unit circuits may each be an identical circuit; and the unit circuits may each be arranged periodically in the direction of the metal wires and connected with each other. According to the above configuration, the design, the configuration, and the manufacture of the antenna may be simplified.

In the dipole antenna in accordance with this aspect, both ends of each of the plurality of metal wires may be open. According to the above configuration, since the current is strong around the feed point of the antenna, that is, the peak of the resonance is produced around the feed point which is at the middle of the antenna, the generation and increase of reflected waves at the feed point may be controlled.

In the dipole antenna in accordance with this aspect, the unit circuits may have a second inductor provided in series on a metal wire other than the one on which the first capacitor is disposed. According to the above configuration, the design of a left-handed circuit is facilitated.

In the dipole antenna in accordance with this aspect, the tie portion of each of the unit circuits may have a second capacitor connected in parallel with the first inductor.

In the dipole antenna in accordance with this aspect, the first inductor may be composed of a meandering inductor pattern. According to the above configuration, a small antenna with multiple-resonance characteristics is realized, and the dipole antenna may be formed on an inexpective substrate, by forming the metal wires with conductor patterns.

In the dipole antenna in accordance with this aspect, the first capacitor may be composed of a comb-shaped interdigital capacitor pattern.

In the dipole antenna in accordance with this aspect, the first capacitor and the first inductor may be composed of a lumped element. According to the above configuration, since the antenna may be composed of metal wires and lumped elements (chip elements), a dipole antenna with desired characteristics may be manufactured within a short period.

The dipole antenna in accordance with this aspect may include a flexible substrate on which conductor patterns are stacked; the first inductor may be composed of a meandering inductor pattern constituted of the conductor patterns; and the first capacitor may be composed of a comb-shaped interdigital capacitor pattern constituted of the conductor patterns.

According to the above configuration, the dipole antenna may be formed using only the conductor patterns, and the use of the flexible substrate facilitates the formation of the bent portions.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
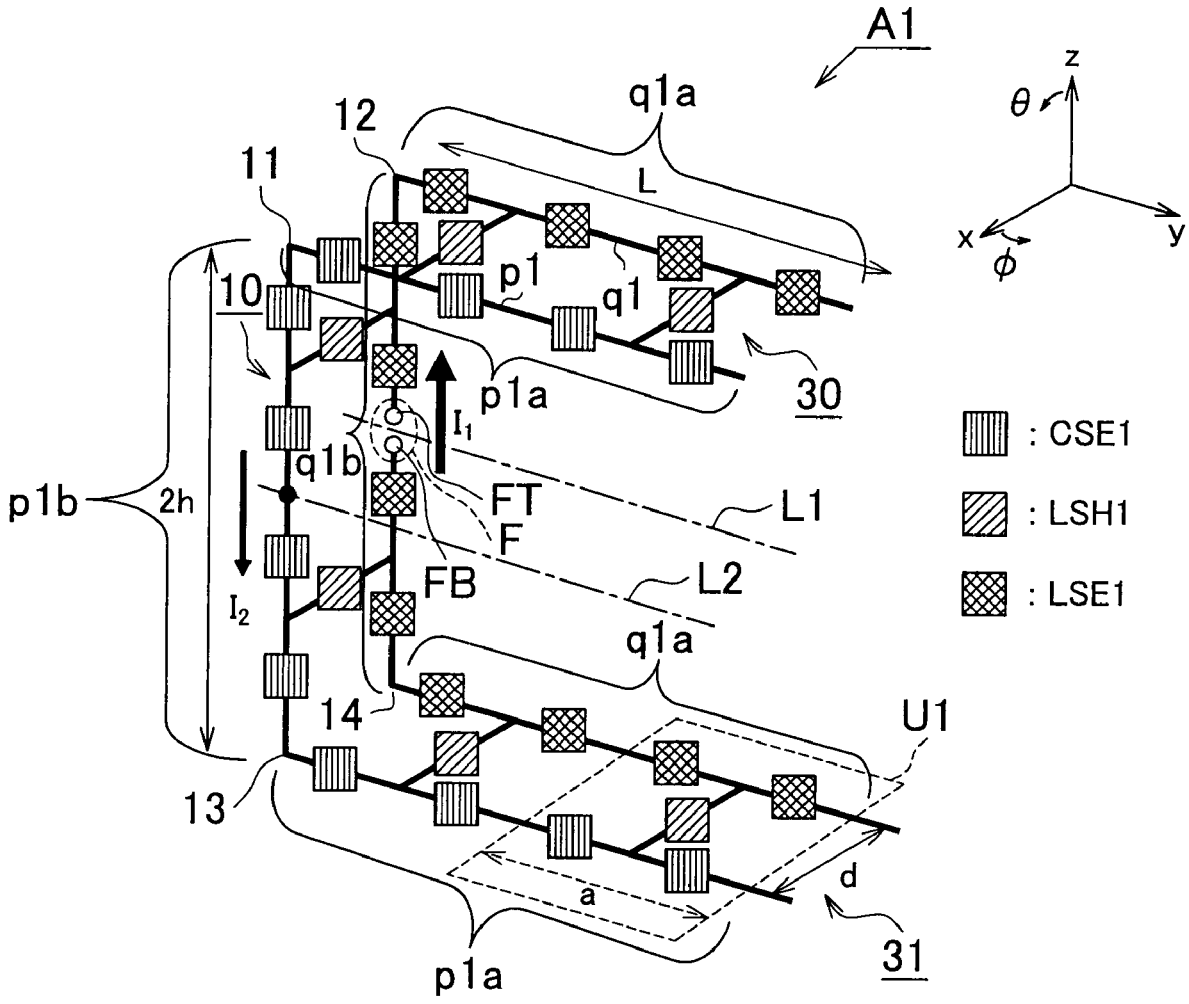
FIG. 1 is a perspective view that shows the configuration of a dipole antenna in accordance with a first embodiment of the present invention.

Referring to the drawings, a description will be made of specific embodiments of the present invention, to which the present invention is not limited.

FIG. 1 is a perspective view of a dipole antenna A1 in accordance with a first embodiment of the invention. The dipole antenna A1 is composed of two parallel metal wires p1, q1 as its basic structure, and six unit circuits U1 of length (the dimension in the direction parallel to the metal wires p1, q1) a and width (the gap between the metal wires p1, q1) d connected in the longitudinal direction of the metal wires p1, q1.

The unit circuits U1 are each composed of two capacitors CSE1, as an example of the first capacitor of the present invention, connected in series on a part of the metal wire p1, two inductors LSE1, as an example of the second inductor of the present invention, connected in series on a part of the metal wire q1, and a tie portion that ties the metal wires p1 and q1 via an inductor LSH1, as an example of the second inductor of the present invention. The inductors LSE1 are provided to adjust the two resonance frequencies and the impedance.

The dipole antenna A1 has a base portion 10 constituted of metal wires p1*b* and q1*b* formed to extend in the polarization direction of radiation waves, and a pair of extended portions 30, 31 constituted of a pair of metal wires p1*a* bent at bent portions 11, 13 at an angle of 90 degrees with respect to the base portion 10 and a pair of metal wires q1*a* bent at bent portions 12, 14 at an angle of 90 degrees with respect to the base portion 10. At the middle portion of the base portion 10, a feed point F constituted of points FT, FB is provided at the midpoint of the metal wire q1*b* on which the inductors LSE1 are provided in series.

The metal wires p1, q1 are bent at two bent portions (11, 12) and (13, 14) at an angle of 90 degrees with respect to the plane including the metal wires p1*b*, q1*b*, that is, the plane including the base portion 10 which is the middle portion of the metal wire p1, q1 (an x-z plane of FIG. 1). The metal wire q1 has a squared U-shape which is symmetric with respect to a symmetry axis L1, or the line extending in the y-axis direction and passing through the feed point F. The metal wire p1 has a squared U-shape which is symmetric with respect to a symmetry axis L2, or the line extending in the y-axis direction and passing through the midpoint of the metal wire p1*b*. Of the components of the squared U-shape, the extended portions 30, 31, which are constituted of two parallel line segments p1*a*, q1*a* composing the metal wires p1, q1 (that is, line segments composing the metal wires p1, q1 and extending along the y-axis direction in the drawing), are each constituted of two unit circuits U1. The base portion 10, which is constituted of line segments p1*b*, q1*b* composing the metal wires p1, q1 and connected perpendicularly to the line segments p1*a*, q1*b* (that is, line segments composing the metal wires p1, q1 and extending along the z-axis direction in the drawing), is constituted of two unit circuits U1. Therefore, the ratio between the length L of the line segments p1*a*, q1*a* composing the extended portions 30, 31 and the length 2*h* of the line segments p1*b*, q1*b* composing the base portion 10 is 1:1. Land 2*h* are set to 60 mm. Both ends of the dipole antenna A1 (both ends of the metal wires p1, q1) are open.

The dipole antenna A1 may operate as a left-handed antenna with the capacitors CSE1, which are provided on the metal wire p1, and the inductors LSH1, which are provided between the metal wires p1 and q1, arranged periodically. Currents I1 and I2 respectively flow through the metal wires q1, p1 in opposite phases and with different amplitudes. Thus, the current components that contribute to the radiation is represented by $|I1|-|I2|$.

A description will next be made of the operation of the dipole antenna A1 as a dual-resonance antenna that operates as a left-handed antenna, with reference to FIGS. 2A to 2E which show the relationship between the current distribution and the excitation mode. Here, the resonance order n, the excitation current wavelength λa, and the antenna length (h+L) have a relationship represented by the equation $2(h+L)=|n|\lambda a/2$.

FIGS. 2A to 2E respectively show the distribution of current ($|I1|-|I2|$) with n=−1 to −5. In FIGS. 2A to 2E, in order to show the distribution of current $|I1|-|I2|$, the dipole antenna A1 is shown as a squared U-shape along a y-z plane and with the metal wires p1 and q1 collectively represented by a single line. Thus, the line segments p1*a* and q1*a* of the extended portion 30 in the upper part of FIG. 1 in the z-axis direction correspond to the line segment a in FIGS. 2A to 2E, the line segments p1*a* and q1*a* of the extended portion 31 in the lower part of FIG. 1 in the z-axis direction correspond to the line segment b in FIGS. 2A to 2E, and the line segments p1*b* and q1*b* of the base portion 10 in FIG. 1 correspond to the line segment c in FIGS. 2A to 2E. The circular mark on the line segment c indicates the position of the feed point F.

Figure 2A:
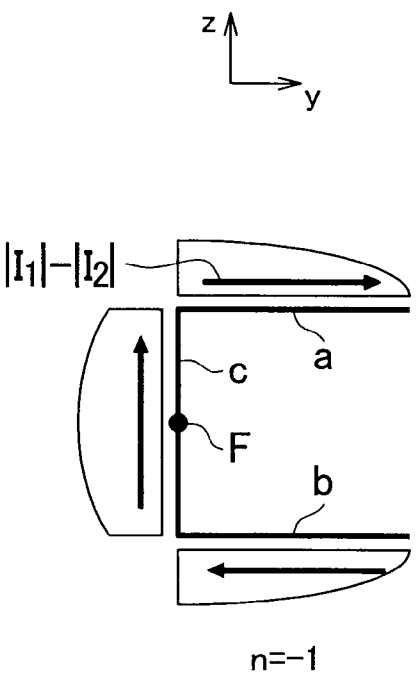
FIGS. 2A, 2B, 2C, 2D, and 2E show the current distribution at respective resonance orders in the dipole antenna in accordance with the first embodiment of the present invention.
Figure 2B:
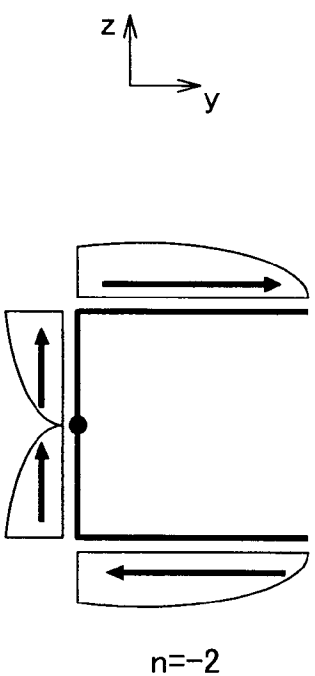
Figure 2C:
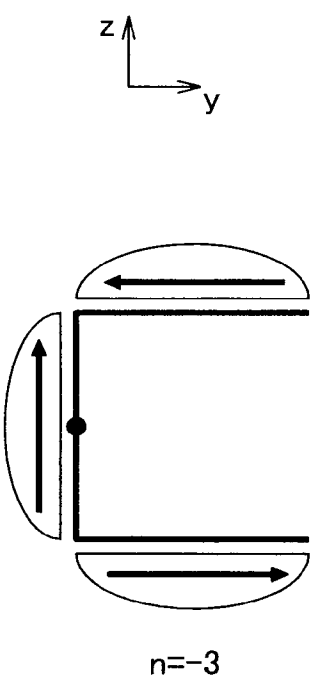
Figure 2E:
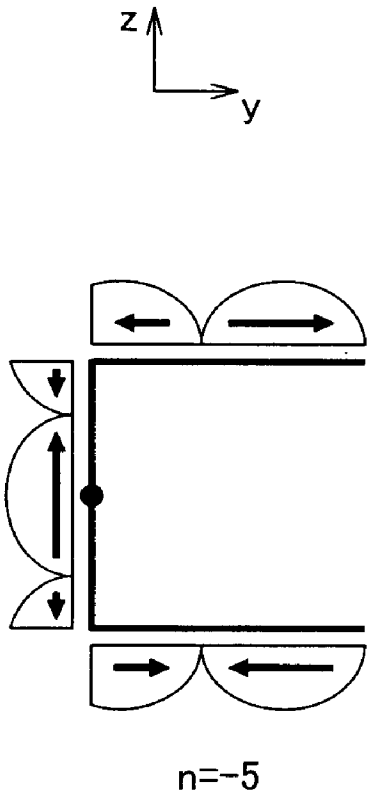
Figure 2D:
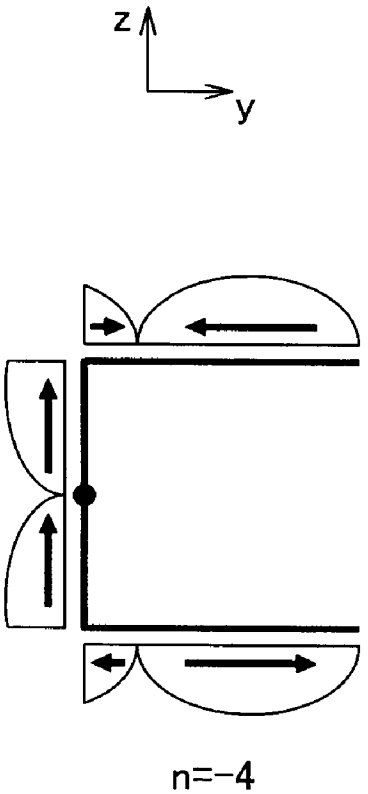

As shown in FIGS. 2A to 2E, the currents flowing the two parallel line segments a and b flow in opposite directions. Thus, in the case where the length 2*h* of the line segment c is sufficiently small relative to the free-space wavelength, the currents cancel each other and do not contribute to the radiation. As shown in FIGS. 2B and 2D, in the case where n is an even number, the current reaches a minimum at the feed point F, and therefore the input impedance is extremely high. On the other hand, as shown in FIGS. 2A, 2C, and 2E, in the case where n is an odd number, the current reaches a maximum at the feed point F, and therefore impedance matching may be achieved. With n=−1 and n=−3, the current that flows through the line segment C of the base portion 10 is the source of radiation waves. With n=−5, the current that flows through the line segment C of the base portion 10 contains components in opposite directions, and therefore the amount of the radiation is extremely small. As described above, the dipole antenna A1 is a dual-resonance antenna that operates in two modes of n=−1 and n=−3.

Figure 3A:
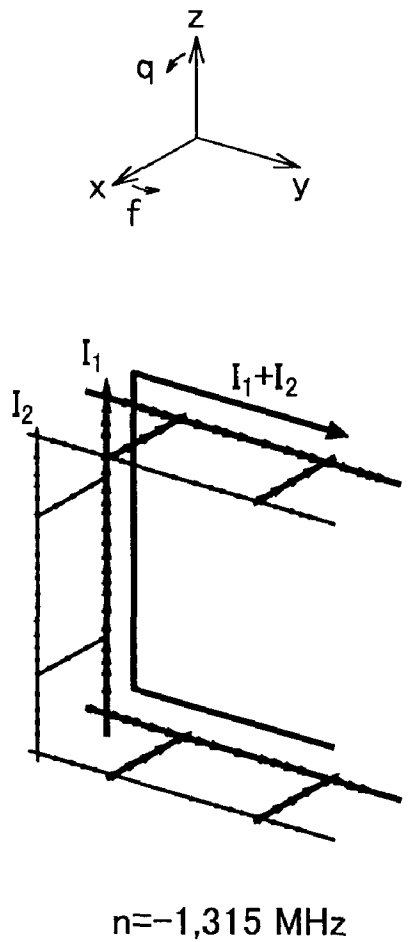
FIGS. 3A, 3B, and 3C show the current distribution respectively with n=−1, −3, and −5 in the dipole antenna in accordance with the first embodiment of the present invention.
Figure 3B:
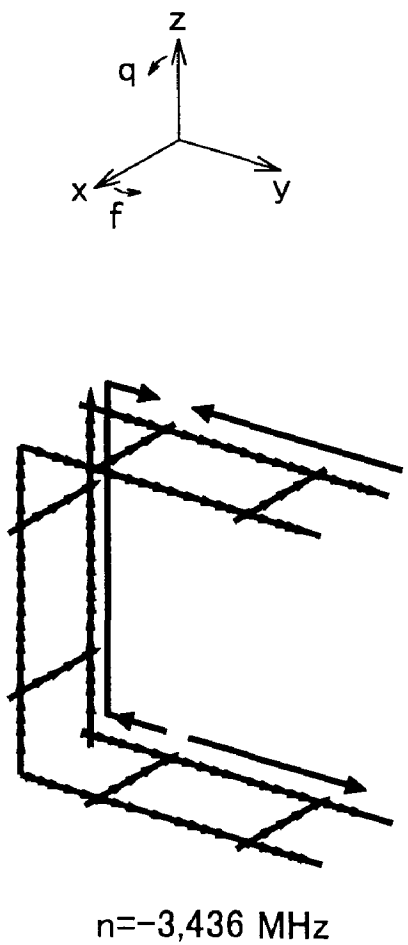
Figure 3C:
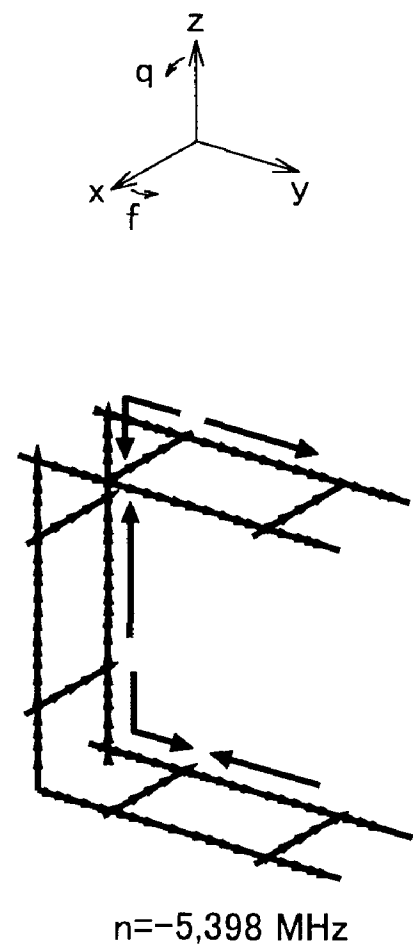

FIGS. 3A to 3C respectively show the simulation results of the current distribution with n=−1, −3, and −5. The conical marks on the lines indicate the current direction with the direction of the vertex of the cone, and the current intensity with the size of the cone. From these, it is apparent that the current flows as shown in FIGS. 2A, 2C, and 2E. The resonance frequency was 315 MHz with n=−1, 436 MHz with n=−3, and 398 MHz with n=−5. Although the resonance frequency generally decreases as |n| increases in a left-handed antenna, the resonance frequency decreases consecutively in the order of n=−3, n=−5, and n=−1 with the dipole antenna A1. This is due to the inductors LSE1, which are provided to facilitate adjustment of the resonance frequencies and the impedance.

Figure 4A:
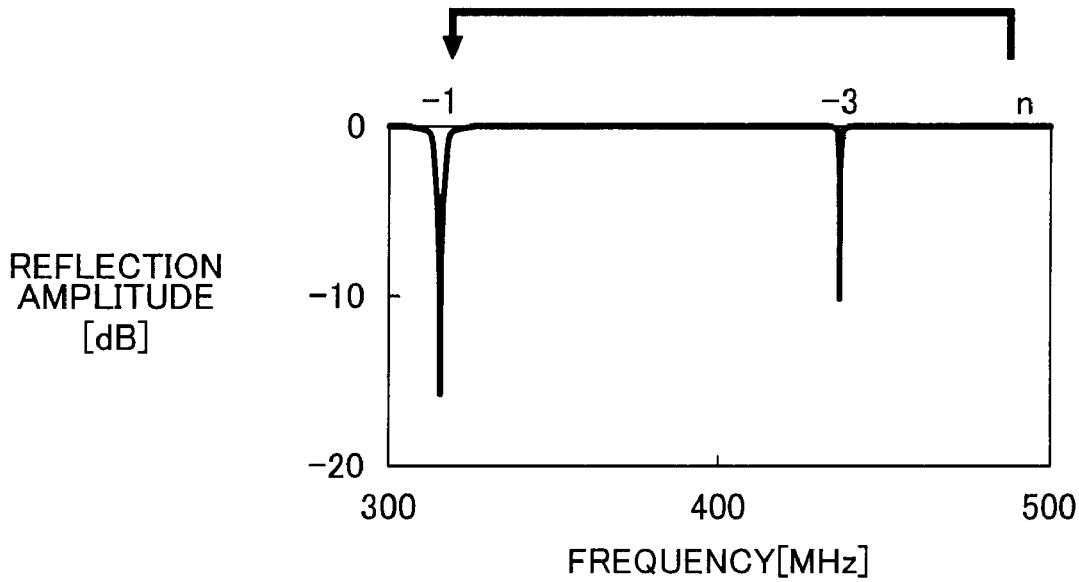
FIG. 4A is a chart that shows the relationship between the reflection amplitude and the frequency of the dipole antenna in accordance with the first embodiment of the present invention.
Figure 4B:
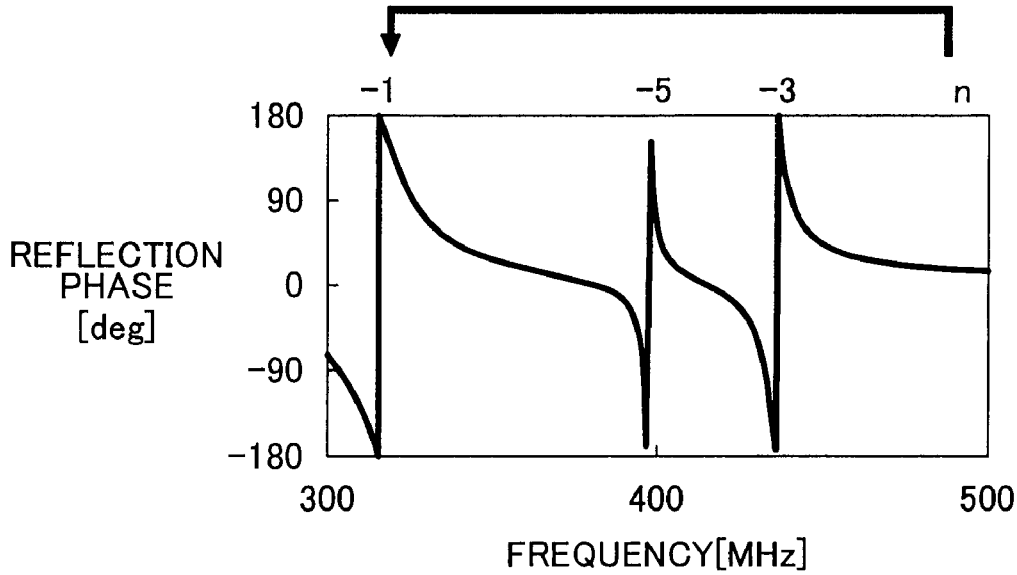
FIG. 4B is a chart that shows the relationship between the reflection phase and the frequency thereof.

FIGS. 4A and 4B show the relationship between the reflection amplitude and the frequency and that between the reflection phase and the frequency. From FIG. 4A, it is apparent that the resonance is achieved at two frequencies with n=−1 (315 MHz) and with n=−3 (436 MHz). On the other hand, from FIG. 4B, it is apparent that the resonance appears with n=−1, −3, and −5. However, the current that flows through the line segment c of the base portion 10 also has components in opposite directions with n=−5 as described above, and therefore the radiation is extremely small and the resonance does not appear with n=−5 in FIG. 4A.

Figure 5B:
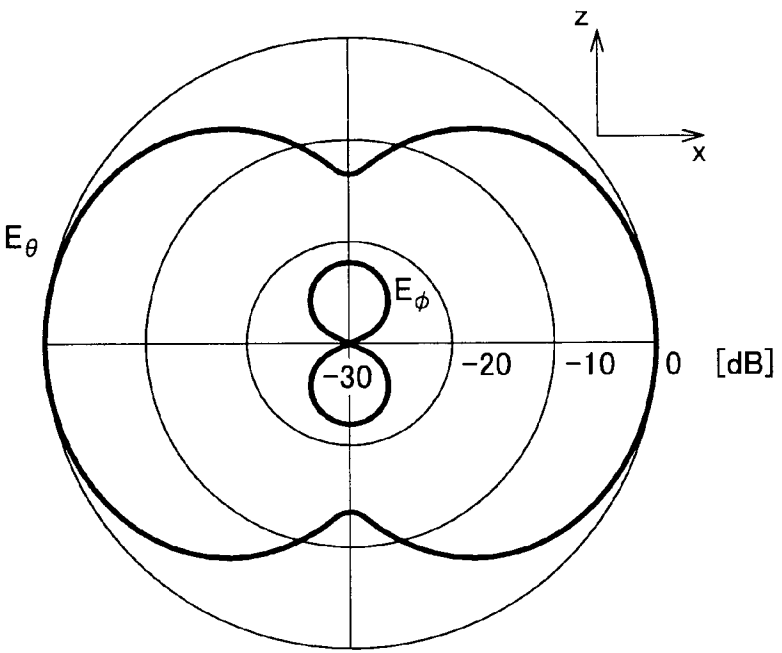
FIGS. 5A and 5B show the directivity with n=−1 of the dipole antenna in accordance with the first embodiment of the present invention.
Figure 5A:
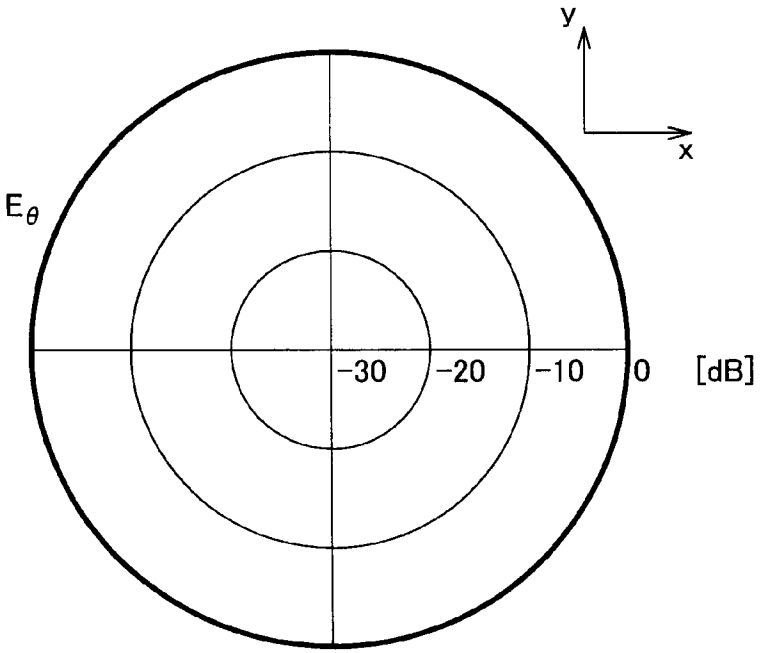
Figure 5D:
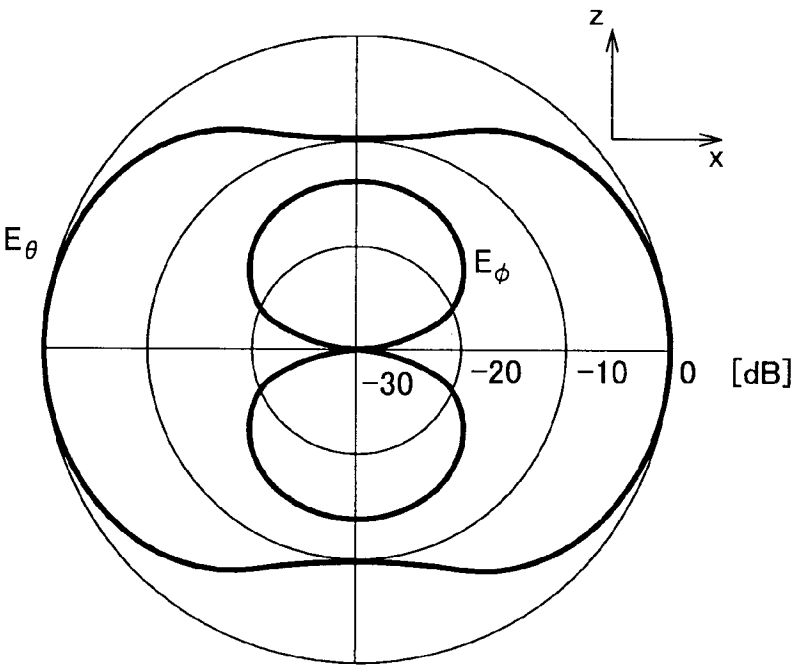
FIGS. 5C and 5D show the directivity with n=−3 thereof.
Figure 5C:
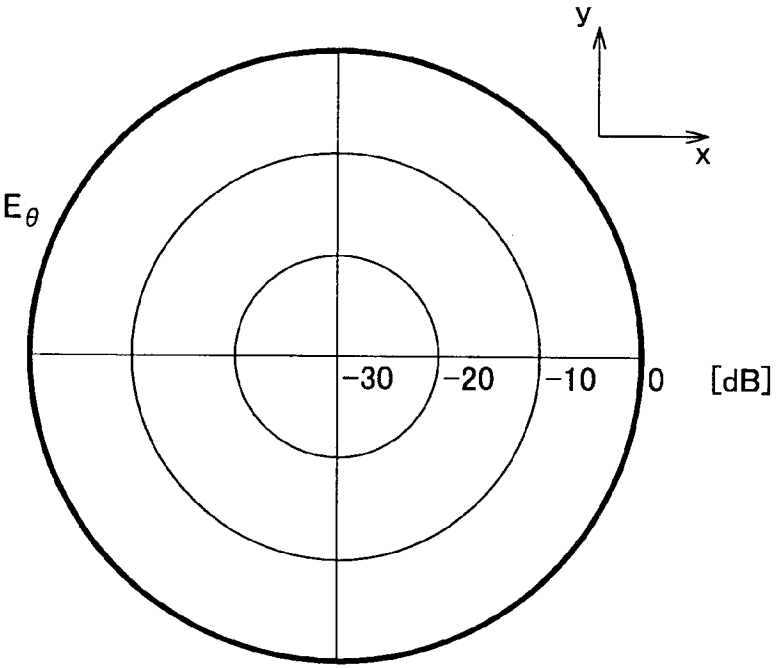

FIGS. 5A to 5D show the directivity in an x-y plane and an x-z plane with n=−1 (315 MHz) and with n=−3 (436 MHz). FIGS. 5A and 5C show the directivity in an x-y plane, from which no directivity can be observed with either n=−1 or n=−3. FIGS. 5B and 5D show the directivity in an x-z plane, from which the figure-eight directivity with maximum radiation in the x-axis direction can be observed with both n=−1 and n=−3. From these, it is apparent that the current that flows through the line segment c (line segments q1*b*, p1*b*) is the source of radiation waves.

Figure 6:
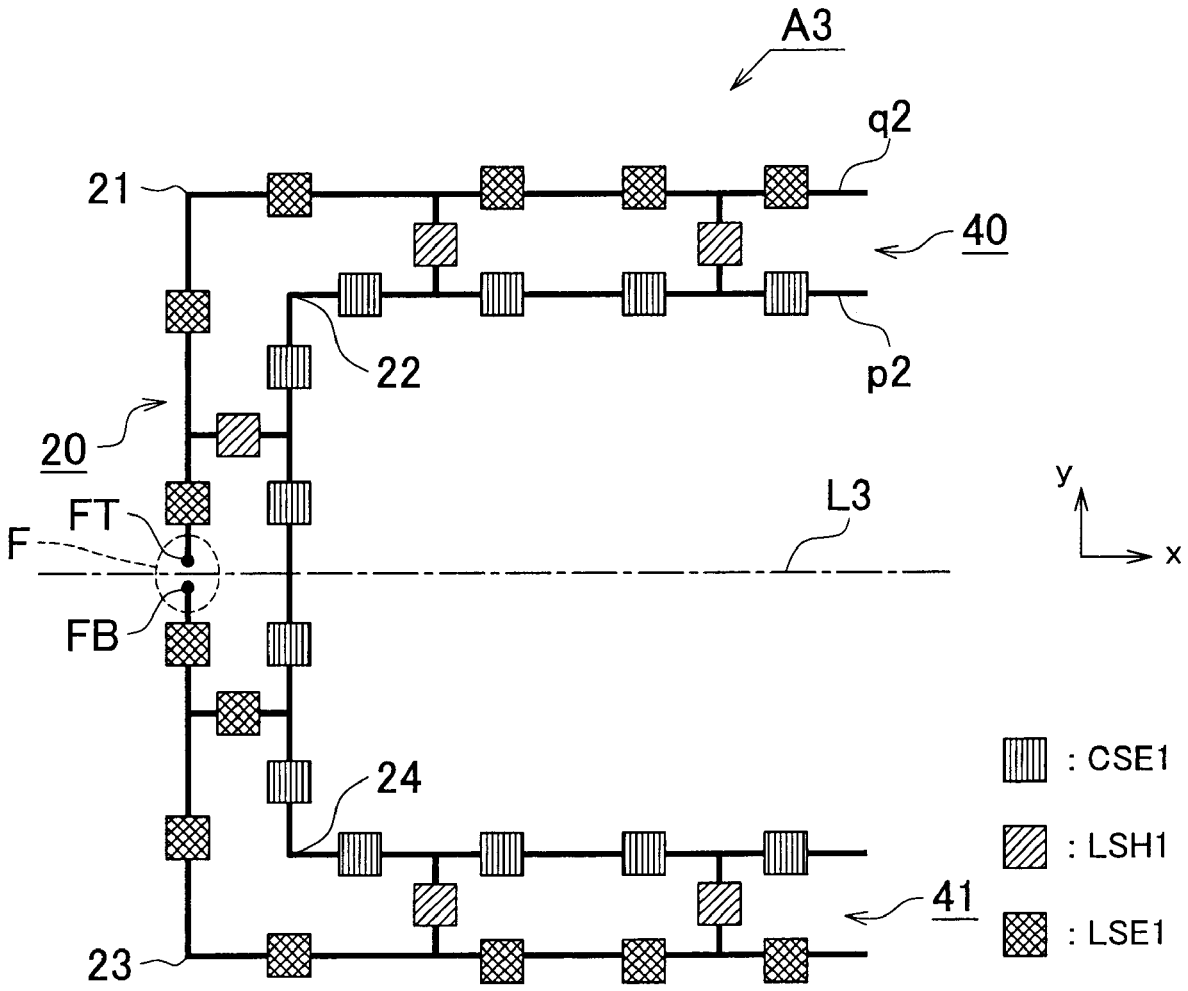
FIG. 6 is a plan view that shows the configuration of a dipole antenna in accordance with a second embodiment of the present invention.

FIG. 6 is a plan view of a dipole antenna A2 in accordance with a second embodiment of the present invention. The dipole antenna A2 has, as its basic structure, two parallel metal wires p2, q2 which are disposed in an x-y plane. The dipole antenna A2 has a base portion 20 extending in the polarization direction of radiation waves from the metal wires p2, q2 (y-axis direction), and extended portions 40, 41 provided in the plane in which the base portion 20 is disposed and formed to be bent at an angle of 90 degrees with respect to the base portion 20. A feed point F constituted of points FT, FB is provided at the middle of the base portion 2 of the metal wire q2. The metal wire q2 has the same shape as the metal wire q1. That is, the metal wire q2 has a shape with two bent portions (21, 23) at an angle of 90 degrees (squared U-shape) so as to be symmetric with respect to a symmetry axis L3 passing through the feed point F and extending perpendicularly to the y-axis. The metal wire p2 is disposed on the inner side of the metal wire q2 with a gap d, and has a squared U-shape with two bent portions (22, 24) at an angle of 90 degrees so as to be symmetric with respect to the symmetric axis L3. Thus, the metal wire q2 is longer than the metal wire p2.

The dipole antenna A2 is composed by connecting six generally identical unit circuits. In the same way as in the dipole antenna A1, the unit circuits are each composed of two capacitors CSE1 connected in series on a part of the metal wire p2, two inductors LSE1 connected in series on a part of the metal wire q2, and a tie portion that ties the metal wires p1 and q1 via an inductor LSH1.

The dipole antenna A2 may also operate as a left-handed antenna, with the capacitors CSE1, which are provided on the metal wire p2, and the inductors LSH1, which are provided between the metal wires p2 and q2, arranged periodically. Due to the squared U-shape of the metal wires p2, q2, multiple-resonance characteristics can be obtained, with current components in the x-axis direction canceling each other and with current components in the y-axis direction containing no components in the opposite direction.

In the above first and second embodiments, the dipole antennas A1, A2 are provided with the inductors LSE1 to facilitate adjustment of the impedance. However, the dipole antennas A1, A2 may also operate as a dual-resonance antenna as a left-handed antenna even without resonance frequencies and the inductors LSE1.

The unit circuit is not limited to the configuration in accordance with the first and second embodiments, and may be configured as disclosed, for example, in JP-A-2006-295873. For example, as a unit circuit U2 shown in FIG. 7, may have an inductor LSE2 connected in series with a capacitor CSE2 the unit circuit on a metal wire p3, and an inductor LSH2 (the second capacitor of the present invention) connected in parallel with a capacitor CSH2 between the metal wires p3, q3. Providing the inductor LSE2 and the capacitor CSH2 facilitates designing a left-handed circuit.

Figure 8:
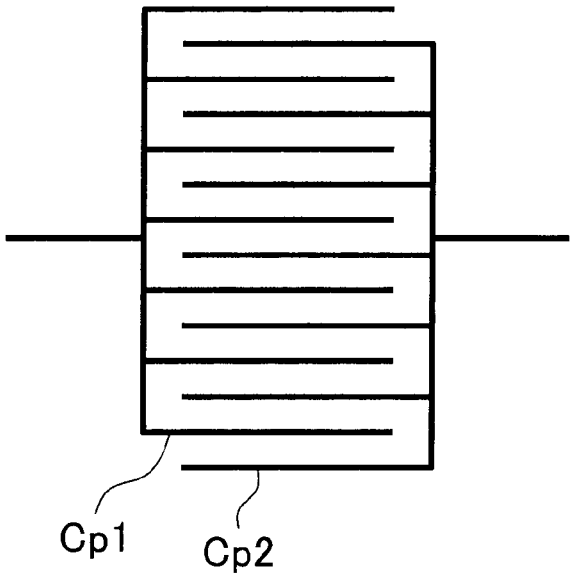
FIG. 8 shows comb-shaped interdigital capacitor patterns in accordance with the first and second embodiments of the present invention.
Figure 9:
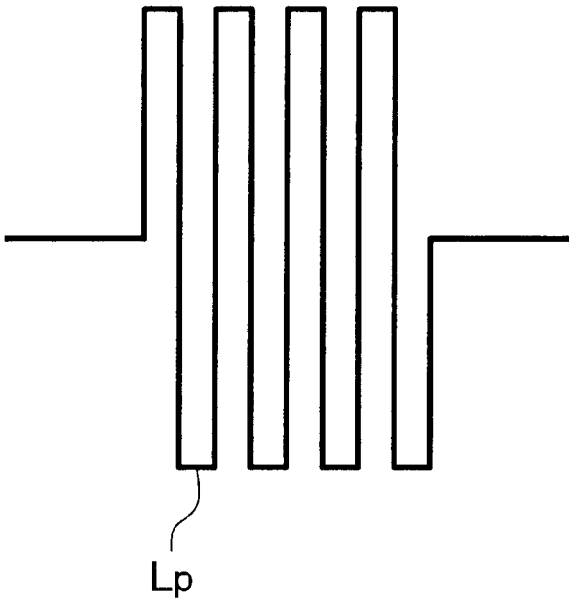
FIG. 9 shows a meandering inductor pattern in accordance with the first and second embodiments of the present invention.

In the dipole antennas A1, A2, the capacitors CSE1 and the inductors LSE1, LSH1 are composed of a lumped element. However, the metal wires p1, q1 may be composed of a conductor pattern, the capacitors CSE1 may be composed of comb-shaped interdigital capacitor patterns Cp1, Cp2 shown in FIG. 8, the inductors LSE1, LSH1 may be composed of a meandering inductor pattern Lp shown in FIG. 9, and these patterns may be stacked on a flexible substrate to compose a dipole antenna. The flexible substrate facilitates the formation of bent portions at an angle of 90 degrees, and a small dual-resonance antenna for use in the single-digit GHz range can be realized at a low cost.

Figure 10:
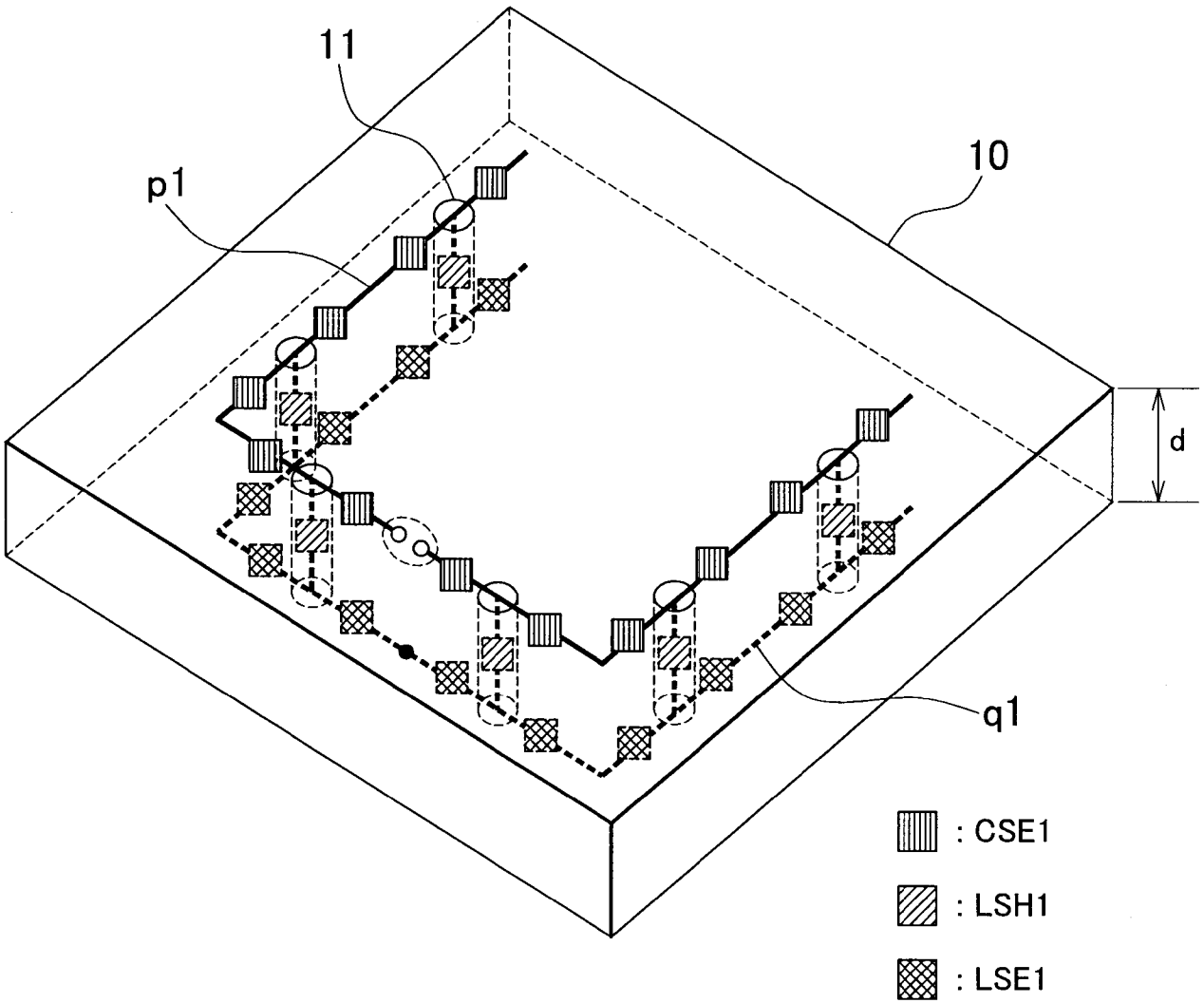
FIG. 10 is a perspective view that shows an example of a dipole antenna in accordance with a third embodiment of the present invention formed on a substrate.

In a third embodiment of the present invention, the dipole antenna A1 is formed using a multilayer printed circuit board. That is, as shown in FIG. 10, the dipole antenna A1 may be formed by forming the metal wire p1 and the capacitors CSE1 on the front surface of a substrate 10 with thickness d, the metal wire q1 and the inductors LSE1 on the back surface of the substrate 10, and the inductors LSH1 in through holes 11.

Figure 11:
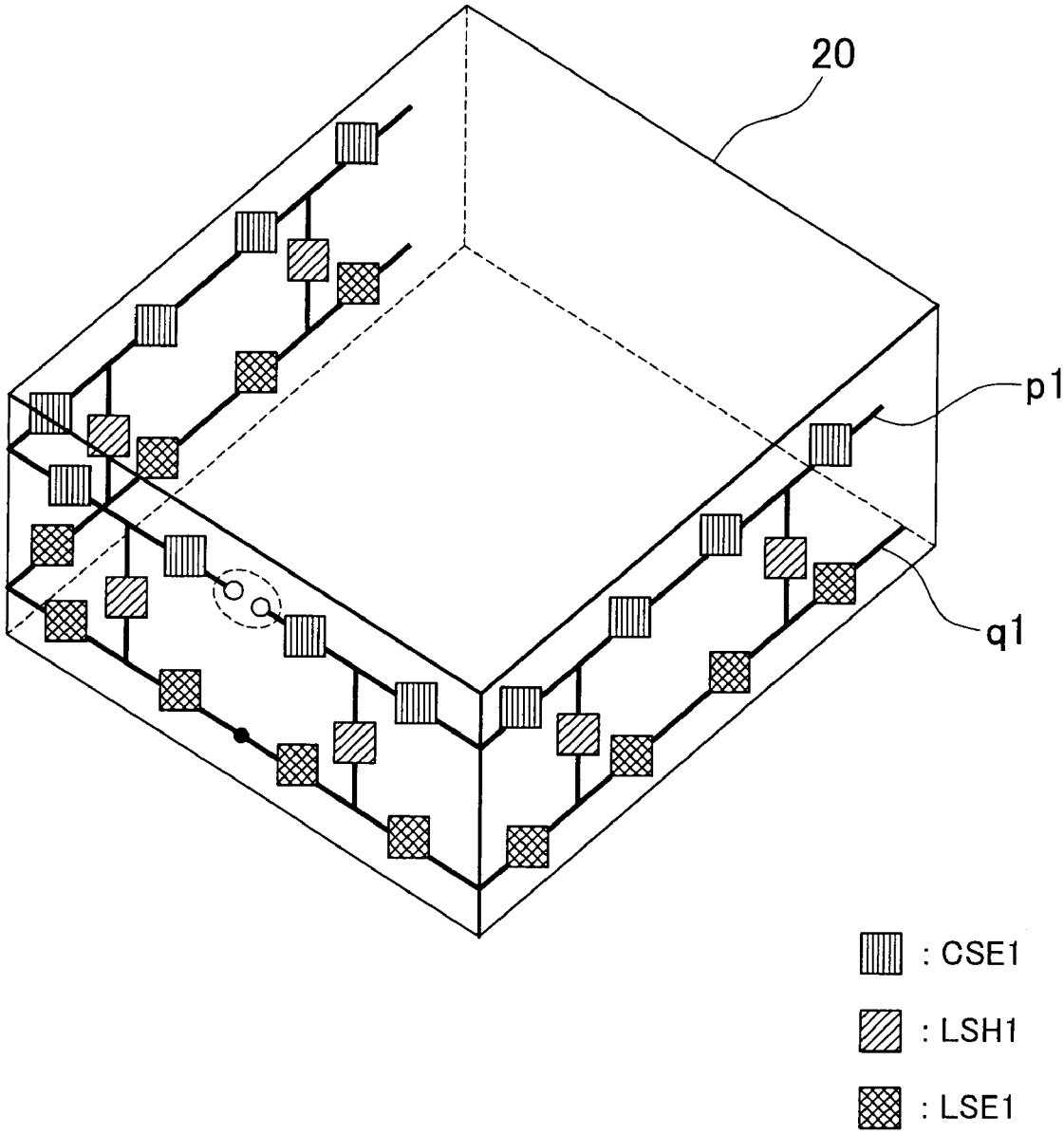
FIG. 11 is a perspective view that shows an example of a dipole antenna in accordance with a fourth embodiment of the present invention formed on side surfaces of a substrate.

In a fourth embodiment of the present invention, as shown in FIG. 11, the dipole antenna A1 may be formed on side surfaces of a square substrate 20.

An inverted-L antenna A3 shown in FIG. 12A, the dual-resonance antenna may be made smaller by forming half of the dipole antenna A1, which is obtained by dividing it along the symmetric axis, on an electrical ground. In this case, the above dipole antenna A1 can be obtained by virtually forming a mirror antenna in the ground with the ground surface serving as a mirror surface.

In the dipole antenna A1 in accordance with the first embodiment, the ratio between 2h and L is set to 1:1 to obtain dual-resonance characteristics. Meanwhile, triple-resonance characteristics may be obtained if the ratio 2h:L is set to 1:2, and in general, (n+1)-resonance characteristics may be obtained when the ratio 2h:L is set to 1:n. This also applies to the dipole antenna A2 in accordance with the second embodiment.

An embodiment of the present invention is not limited to the squared U-shape as in the first embodiment, each metal wire may be formed with bent portions at an angle of 90 degrees so as to be symmetric with respect to a symmetric axis perpendicular thereto. With such a shape, multiple-resonance characteristics can be obtained with current components in directions other than the z-axis direction canceled as in the first embodiment. For example, in a dipole antenna A4 in accordance with a sixth embodiment of the present invention shown in FIG. 13, metal wires p4, q4 in a squared U-shape and of the same length are disposed in an x-y plane with a gap d therebetween. The metal wire p4, q4 intersect at a point B in an insulated manner. The dipole antenna A4 is not symmetric as a whole, but the metal wires p4, q4 are each symmetric with respect to a line. Despite to such a shape, multiple-resonance characteristics may be obtained, with current components in the x-axis direction that flow through the metal wires p4, q4 canceling each other and with current components in the y-axis direction containing no components in the opposite direction.

Although two metal wires are used in the first and second embodiments, three or more metal wires may be used.

Figure 14:
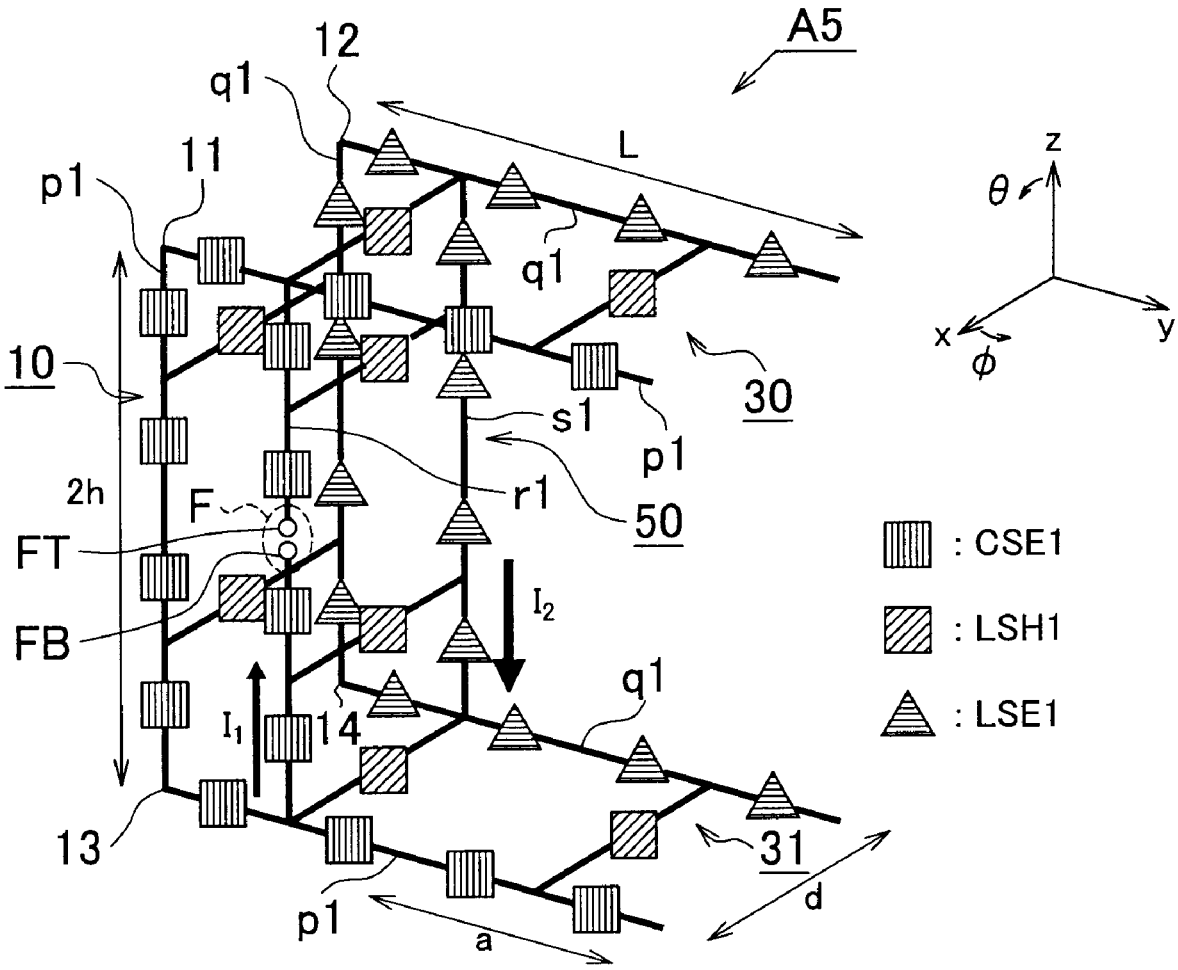
FIG. 14 is a perspective view that shows the configuration of a dipole antenna in accordance with a seventh embodiment of the present invention.

FIG. 14 is a perspective view of a dipole antenna A5 in accordance with a seventh embodiment of the present invention. This embodiment is characterized in that a connection line 50 constituted of metal wires r1, s1 is provided to the dipole antenna A1 in accordance with the first embodiment, parallel to the base portion 10 and on the side of the extended portions 30, 31. It should be noted, however, that different from FIG. 1, a feed point F constituted of points FT, FB is provided at the midpoint of the metal wire r1 on which the capacitors CSE1 are provided in series, of the metal wires r1, s1 composing the connection line 50.

The dipole antenna A5 is composed of eight unit circuits with length a and width d. Some of the unit circuits each have two series capacitors CSE1 on a part of the metal wire p1, two series inductors LSE1 on a part of the metal wire q1, an a parallel inductor LSH1 between the metal wires p1, q1. Likewise, the other unit circuits each have two series capacitors CSE1 on a part of the metal wire r1 composing the connection line 50, two series inductors LSE1 on a part of the metal wire s1 composing the connection line 50, an a parallel inductor LSH1 between the metal wires r1, s1.

The feed point F constituted of the two points FT, FB is positioned generally at the middle of the metal wire r1. The metal wires p1, q1 with the total length 6*a* are bent at two bent portions (11, 12) and (13, 14) at an angle of 90 degrees to have a squared U-shape. Of the metal wires p1, q1 in the squared U-shape, the metal wires composing a pair of parallel extended portions 30, 31 and extending for length 2*a* (corresponding to two unit circuits) from both ends are disposed to extend in the y-axis direction. Also, the metal wires composing a base portion 10 and extending for length 2*a* between the extended portions 30, 31 are disposed to extend in the z-axis direction, or the polarization direction of radiation waves. The metal wires r1, s1 with length 2*a* composing the connection line 50 are disposed to extend in the z-axis direction parallel to the base portion 10, with a gap of a/2 from the base portion 10. The dimensions of the antenna A5 in the x-, y-, and z-axis directions are respectively set to d=20 mm, L=2a=60 mm, and 2h=2a=60 mm.

As in the first embodiment, the antenna A5 operates as a left-handed antenna with the series capacitors CSE1 and the parallel inductors LSH1. The series inductors LSE1 are provided to adjust the two resonance frequencies and the impedance. Currents I1 and I2 respectively flow through the metal wires q1, p1 in opposite phases and with different amplitudes. Thus, the current components that contribute to the radiation is represented by $|I1|-|I2|$, the difference in amplitude between the currents.

Figure 15A:
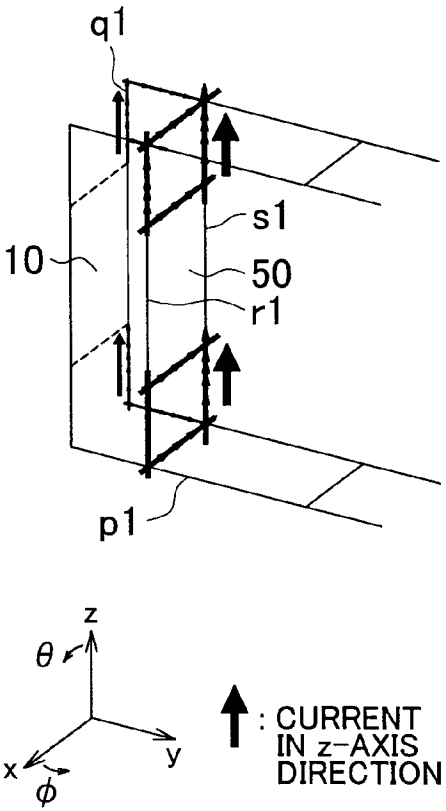
FIGS. 15A, 15B, and 15C show the current distribution at respective resonance orders in the dipole antenna in accordance with the seventh embodiment of the present invention.
Figure 15B:
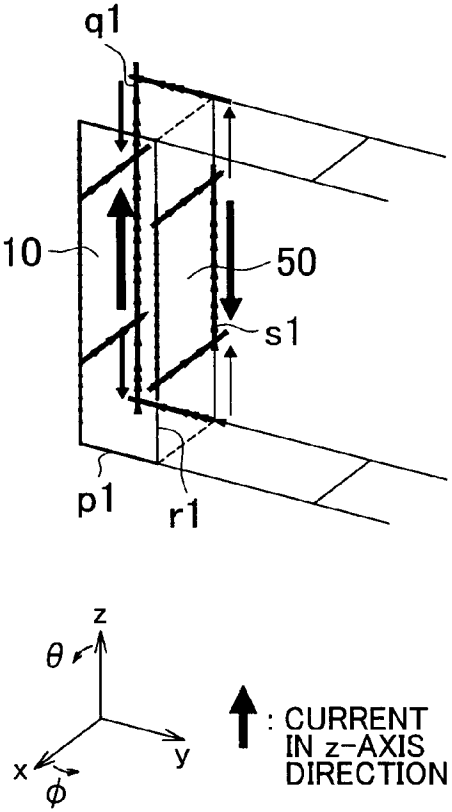
Figure 15C:
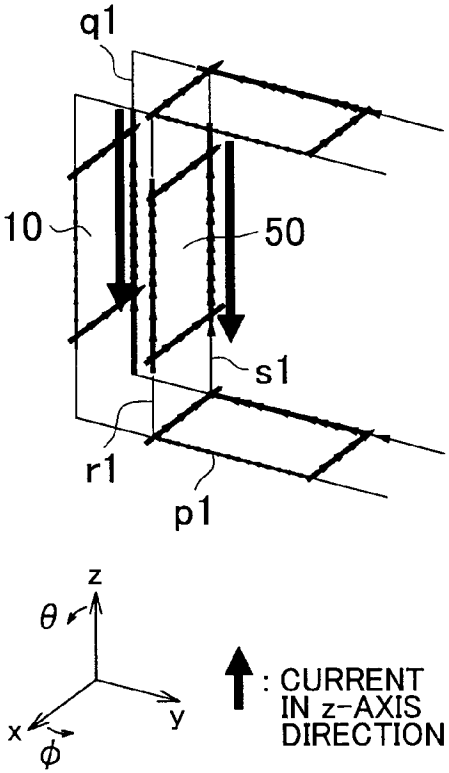

FIGS. 15A, 15B, and 15C respectively show the current distribution at frequencies of 335 MHz, 407 MHz, and 451 MHz. The direction and the size of the arrows on the metal wires respectively indicate the direction and the intensity of the current. In the case where the antenna height 2*h* is sufficiently small relative to the free-space wavelength, the current components in the x-axis and y-axis directions cancel each other, and therefore do not contribute to the radiation. The current components in the z-axis direction contribute to the radiation. The currents flowing through the metal wires q1, p1 of the base portion 10 flow in opposite directions. Likewise, the currents that flow through the metal wires s1, r1 of the connection line 50 are in opposite directions. Further in FIG. 15, the currents that flow through the metal wire q1 of the base portion 10 and the metal wire s1 of the connection line 50, which extend in the z-axis direction, are indicated by an arrow. At 335 MHz and 451 MHz, the flowing through the metal wires q1, s1 flow in the same direction. Thus, strong radiation occurs, which increases the radiation resistance. On the other hand, at 407 MHz, the currents flowing through the metal wires q1, s1 flow in opposite directions. Thus, extremely low radiation occurs.

Figure 16A:
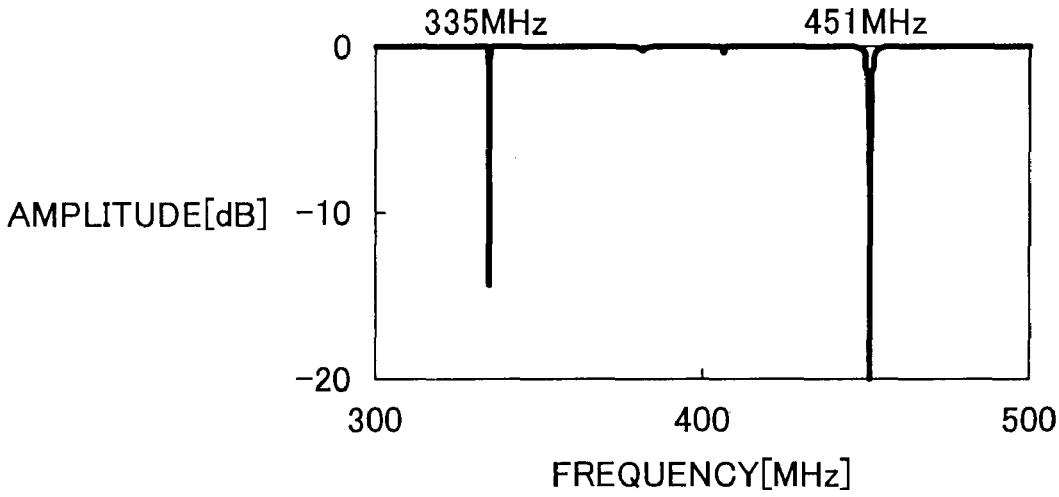
FIG. 16A is a chart that shows the relationship between the reflection amplitude and the frequency of the dipole antenna in accordance with the seventh embodiment of the present invention.
Figure 16B:
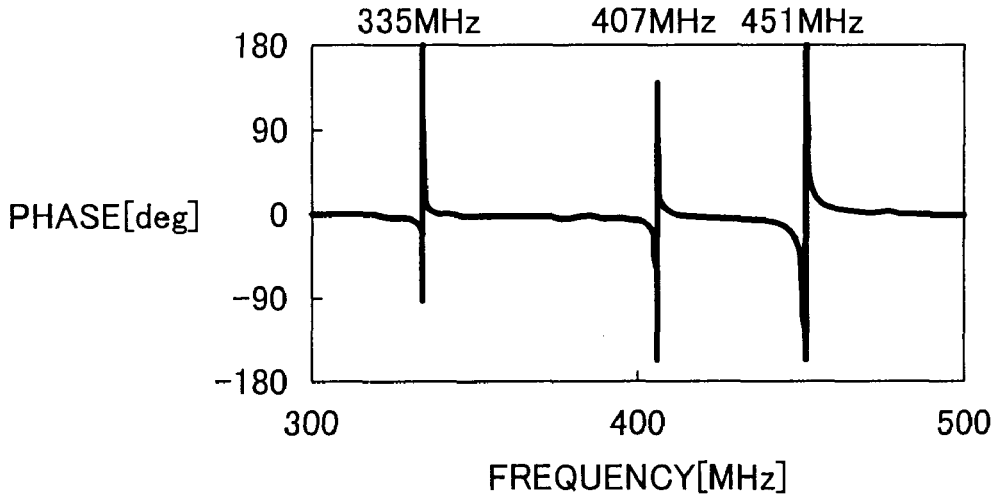
FIG. 16B is a chart that shows the relationship between the reflection phase and the frequency thereof.
Figure 17B:
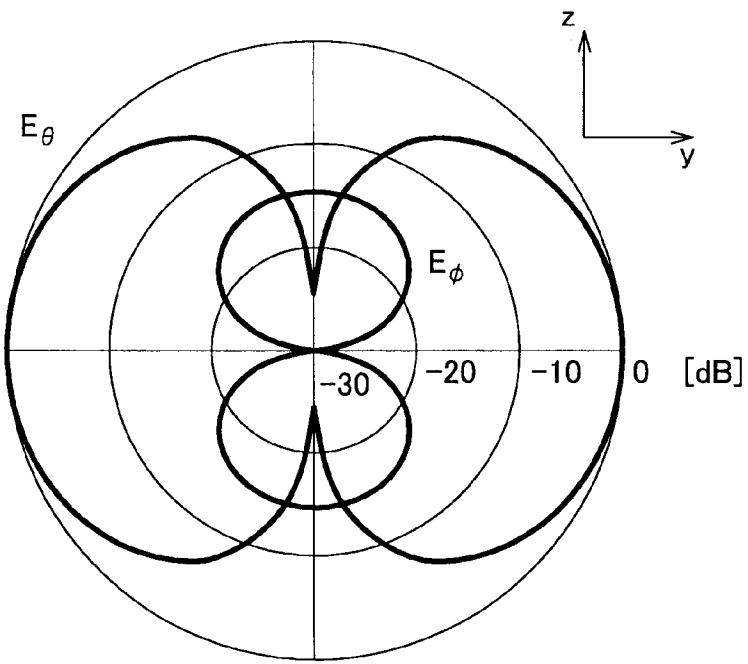
FIGS. 17A and 17B show the directivity with n=−1 of the dipole antenna in accordance with the seventh embodiment of the present invention.
Figure 17A:
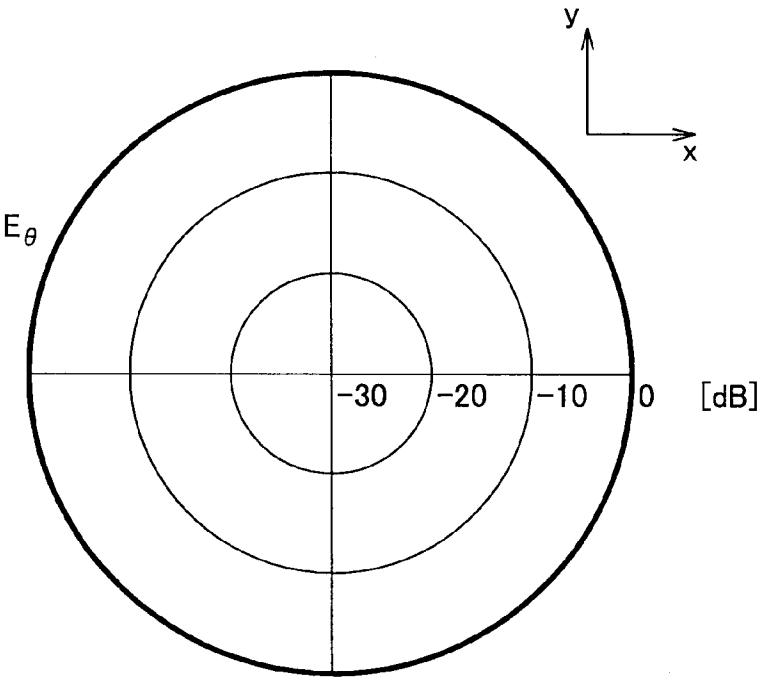
Figure 17D:
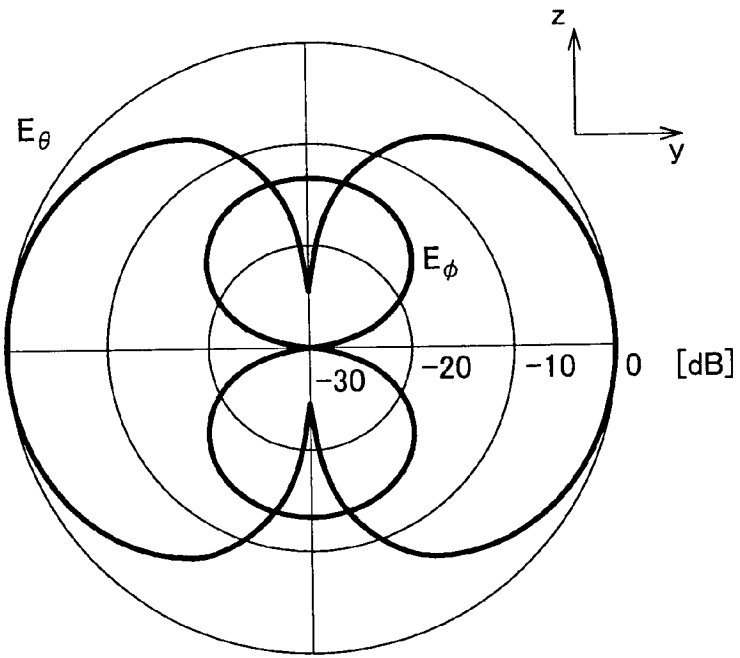
FIGS. 17C and 17D show the directivity with n=−3 thereof.
Figure 17C:
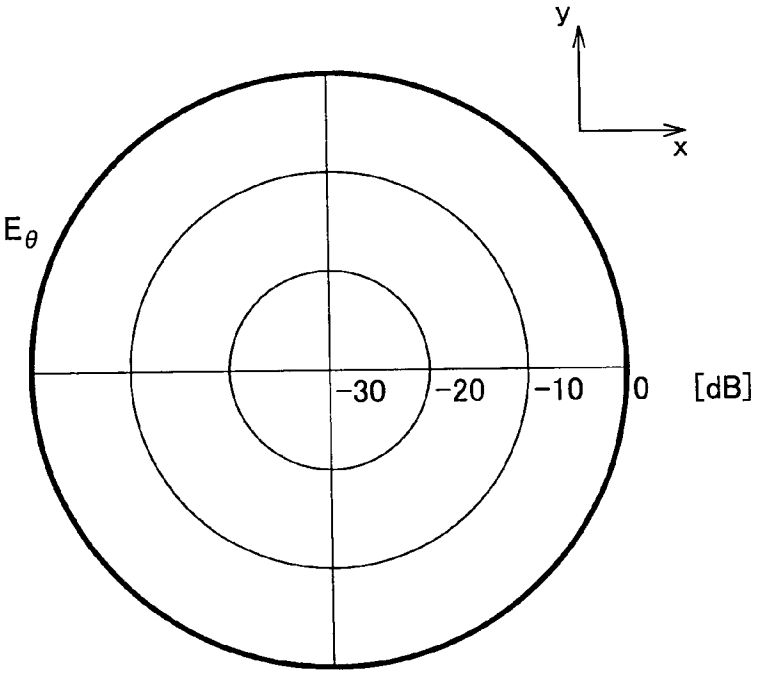

The amplitude and the phase of the impedance are respectively shown in FIGS. 16A and 16B. From the amplitude distribution normalized at 20Ω of FIG. 16A, it is apparent that the resonance is achieved at the frequencies of 315 MHz and 415 MHz. The radiation resistance is respectively 14Ω and 25Ω. On the other hand, from the phase distribution of FIG. 16B, it is apparent that the resonance appears at frequencies of 335 MHz, 407 MHz, and 451 MHz. The reason that the resonance does not appear at 407 MHz in the amplitude distribution is that the current components in the z-axis direction are canceled, which results in extremely low radiation as discussed above.

FIGS. 17A to 17D show the directivity in an x-y plane and a y-z plane at frequencies of 335 MHz and 451 MHz. From FIGS. 17A and 17C, it can be observed that no directivity is formed in an x-y plane at both of the frequencies. Also, from FIGS. 17B and 17D, it can be observed that a figure-of-eight directivity with maximum radiation in the y-axis direction is formed in a y-z plane at both of the frequencies. Further, the directivity in an x-z plane is the same as the one shown in FIGS. 5B and 5D. From these, it is apparent that the current that flows through the metal wires in the z-axis direction (the base portion 10 and the connection line 50) is the source of radiation waves.

Figure 18:
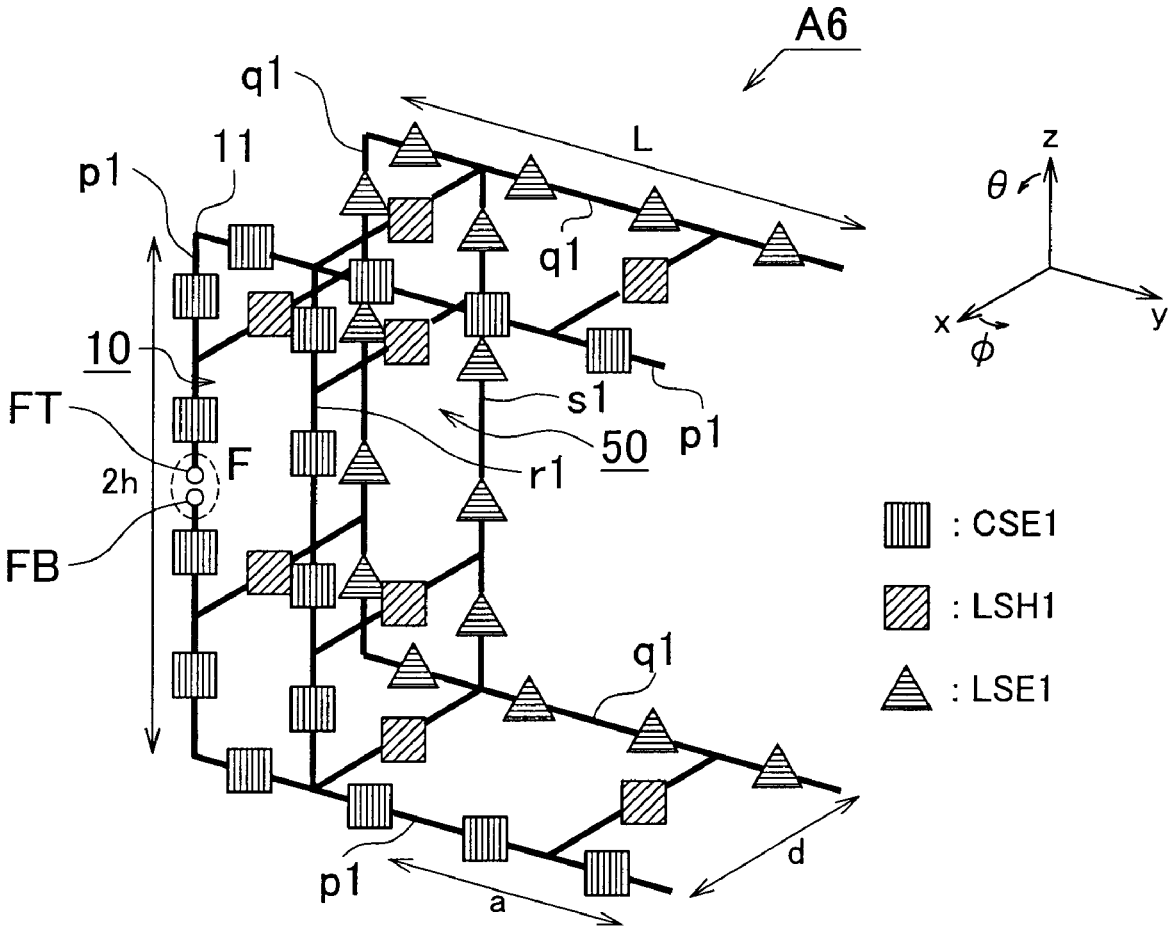
FIG. 18 is a plan view that shows the configuration of a dipole antenna in accordance with an eighth embodiment of the present invention.

FIG. 18 is a perspective view of a dipole antenna A6 in accordance with an eighth embodiment of the present invention. In the dipole antenna A5 in accordance with the seventh embodiment, the feed point F is provided generally at the middle of the metal wire r1 of the connection line 50 on which the capacitors CSE1 are provided. In the dipole antenna A6 in accordance with the eighth embodiment, the feed point F is provided generally at the middle of the metal wire p1 of the base portion 1. Other configurations may be the same as the seventh embodiment.

Figure 19:
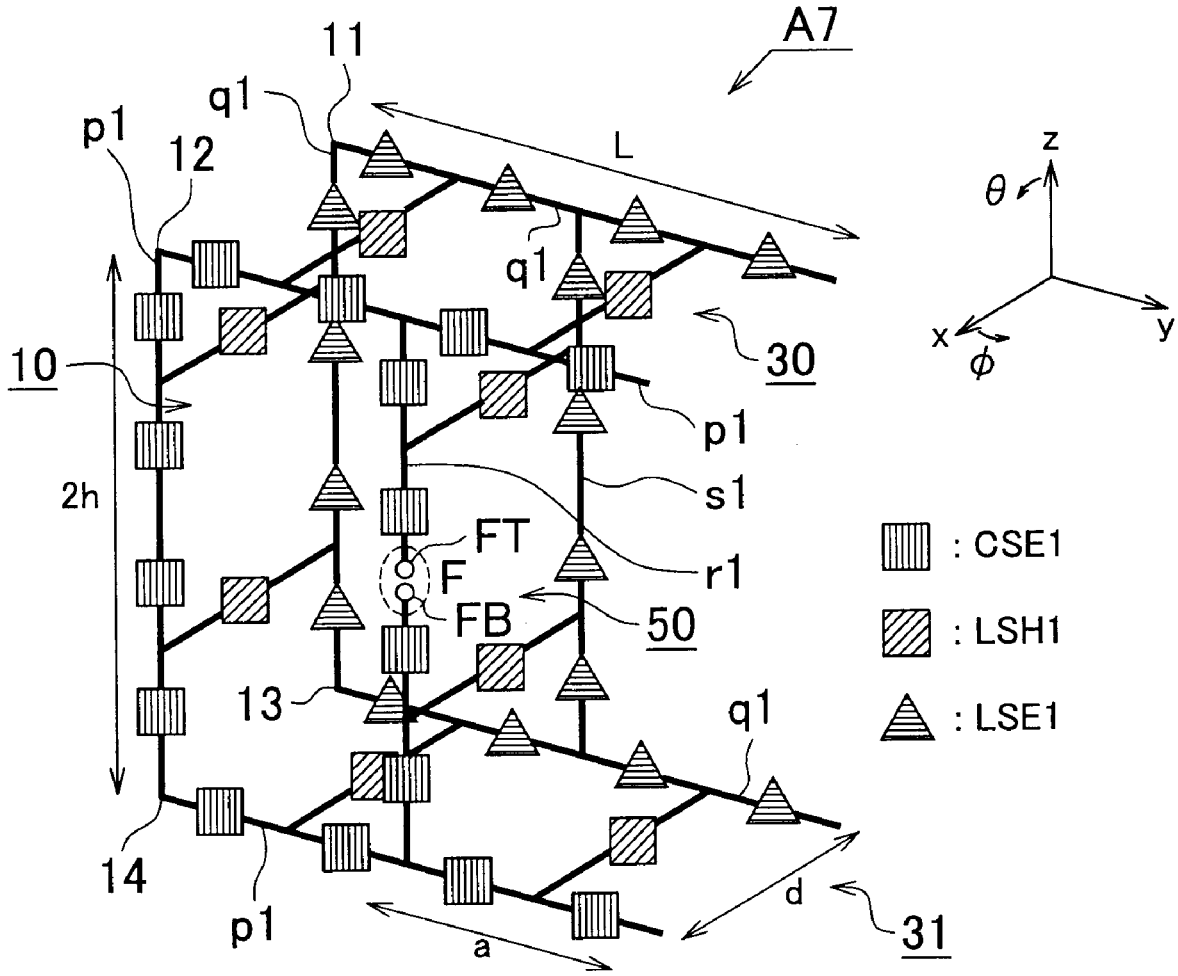
FIG. 19 is a plan view that shows the configuration of a dipole antenna in accordance with a ninth embodiment of the present invention.

FIG. 19 is a perspective view of a dipole antenna A7 in accordance with a ninth embodiment of the present invention. The dipole antenna A7 in accordance with the ninth embodiment is different from the seventh embodiment in that the metal wires r1, s1 of the base portion 10 disposed to extend in the z-axis direction are respectively spaced with distance a from the metal wires p1, q1 of the connection line 50 disposed to extend in the z-axis direction. Other configurations may be the same as the seventh embodiment.

Since the connection line 50 is provided parallel to the base portion 10 in the above seventh, eighth, and ninth embodiments, the impedance of the antenna side at the feed point F is increased, which allows impedance matching at the feed point F. As a result, the power efficiency may be improved.

Figure 12:
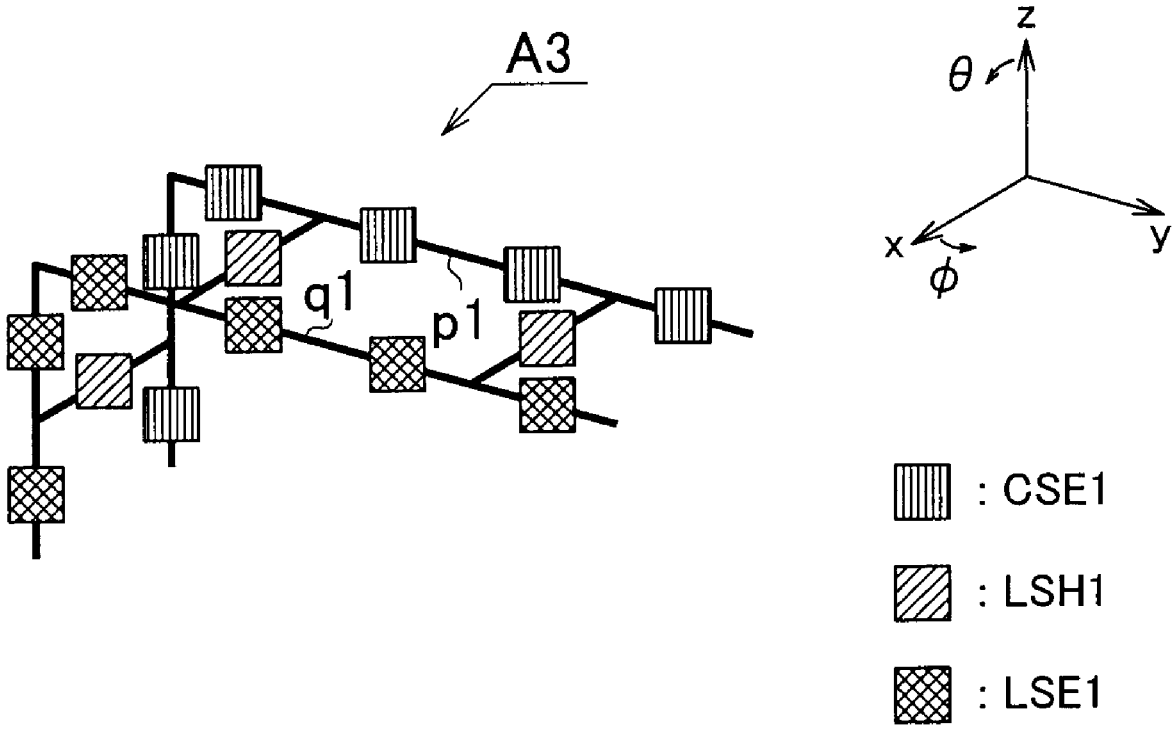
FIG. 12 shows an inverted-L antenna in accordance with a dipole antenna in accordance with a fifth embodiment of the present invention.
Figure 20:
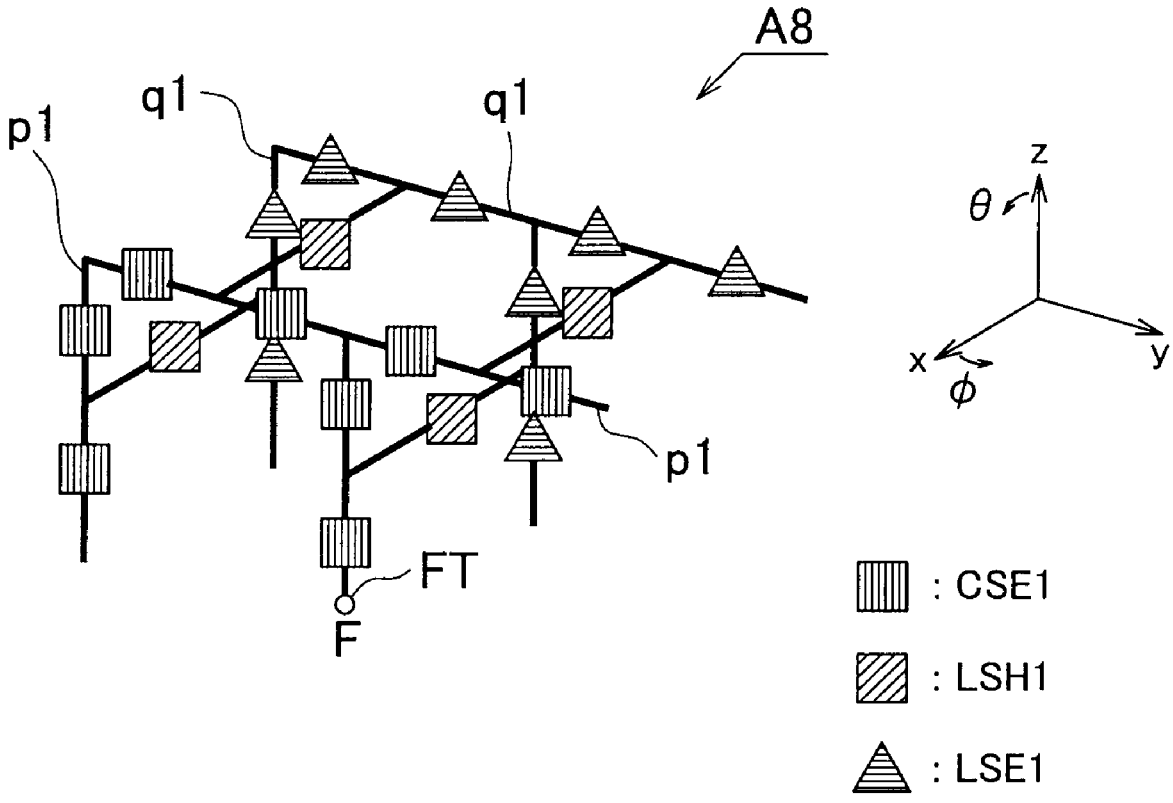
FIG. 20 is a plan view that shows the configuration of a dipole antenna in accordance with a tenth embodiment of the present invention.
Figure 21:
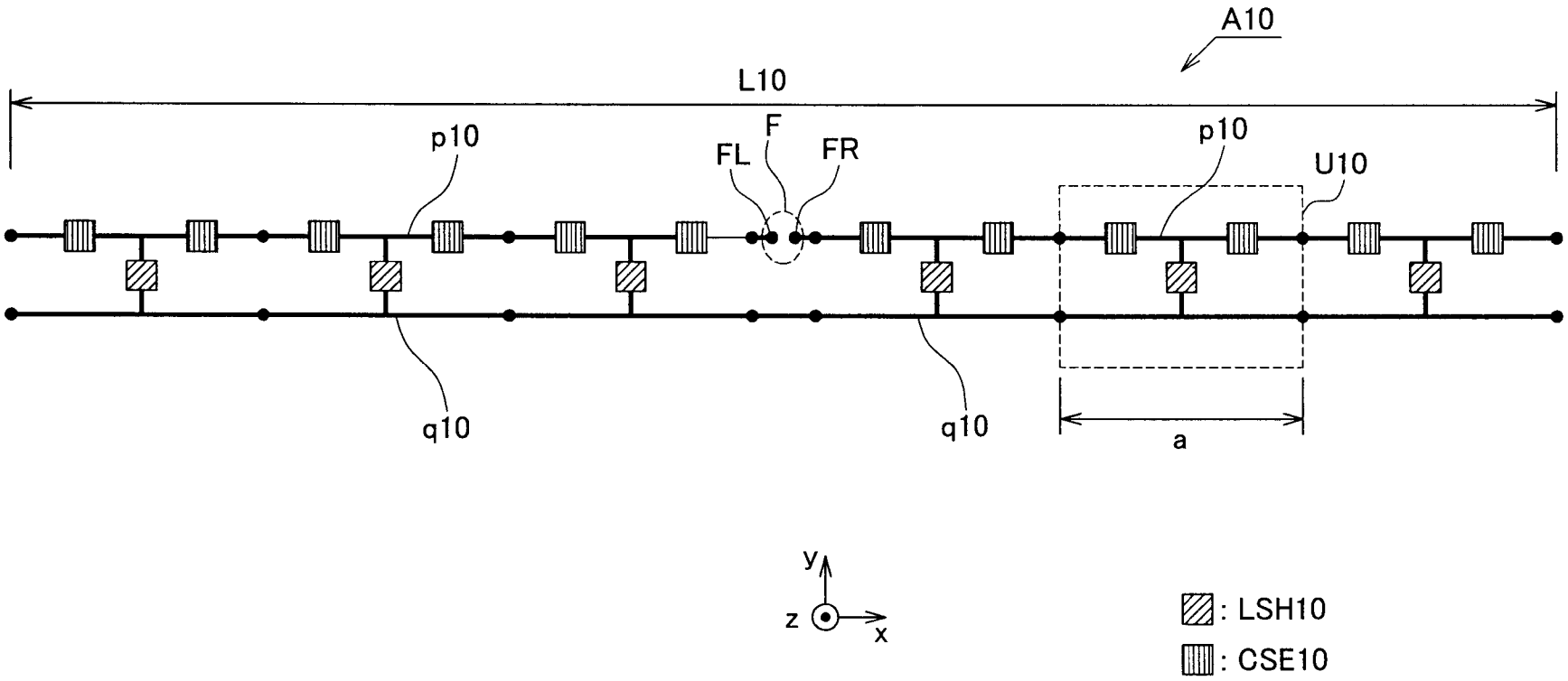
FIG. 21 is a plan view that shows the configuration of a dipole antenna that operates as a left-handed antenna in accordance with a related art.

In a tenth embodiment of the present invention, as shown in FIG. 20, a monopole antenna A8 which is symmetric with respect to a ground conductor may be obtained by forming half of the dipole antennas A5, A6, and A7 on the ground conductor and electromagnetically forming a mirror image in the ground conductor as in the fifth embodiment shown in FIG. 12. According to this configuration, the antenna may be made smaller. That is, the connection line 50 is also provided on the ground conductor parallel to the base portion 10.

In the dipole antennas A5, A6, and A7, the series inductors LSE1 are provided to facilitate adjustment of the resonance frequencies and the impedance. However, the dipole antennas A5, A6, and A7 may operate as a left-handed antenna as a dual-resonance antenna without the series inductors LSE1.

Figure 7:
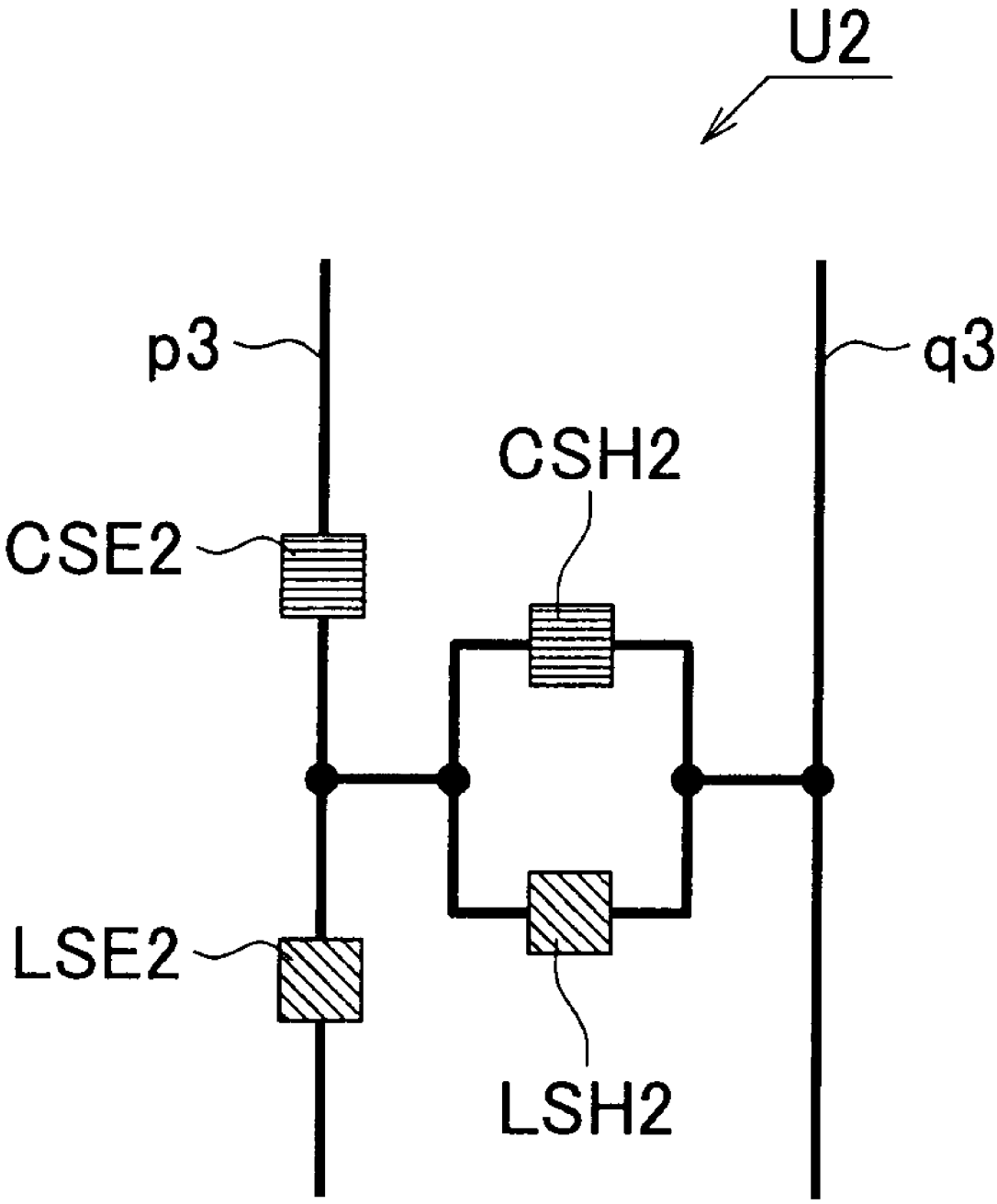
FIG. 7 shows the configuration of a unit circuit U2 with an embodiment of the present invention.

In the dipole antennas A5, A6, and A7, the capacitors CSE1 and the inductors LSH1, LSE1, composed of a lumped element, are provided on the metal wires. However, the metal wires may instead be composed of a conductor pattern, the capacitors CSE1 may be composed of comb-shaped interdigital capacitor patterns shown in FIG. 8, the inductors LSH1, LSE1 may be composed of a meandering inductor pattern shown in FIG. 9, and these patterns may be stacked on a flexible substrate or the like. As shown in FIG. 7, the capacitor CSE2 and the inductor LSE2 may be connected in series on the metal wire p1 and the line r1 of the connection line 50, with no components provided on the metal wires q1, s1, and a circuit of the capacitor CSH2 and the inductor LSH2 connected in parallel may be provided at the connection between the metal wires p1, q1 and at the connection between the metal wires r1, s1.

In the first embodiment, the feed point F is provided on the metal wire q1 on which the inductors LSE1 are provided. However, the feed point F may also be provided on the metal wire p1 on which the capacitors CSE1 are provided.

In the dipole antennas A5, A6, and A7, the ratio of 2h:L is set to 1:1 to obtain dual-resonance characteristics. However, the length L of the extended portions 30, 31 may be increased relative to the length 2*h* of the base portion 10 to obtain triple- or more-higher resonance characteristics. Such characteristics may be obtained in the case where if the current components in the z-axis direction contain no components in the opposite phase.

Although the dipole antennas A5, A6, and A7 have been described as a dual-resonance antenna, it should be understood that they may also be used as a single-resonance antenna.

Further, the dipole antennas A5, A6, and A7 in accordance with the seventh, eighth, and ninth embodiments may be formed by disposing the metal wires p1, r1 and the capacitors CSE1 on the front surface of the substrate 10, disposing the metal wires q1, s1 and the inductors LSE1 on the back surface of the substrate 10, and forming the inductors LSH1 in the through holes 11 as in the third embodiment shown in FIG. 10.

Figure 13:
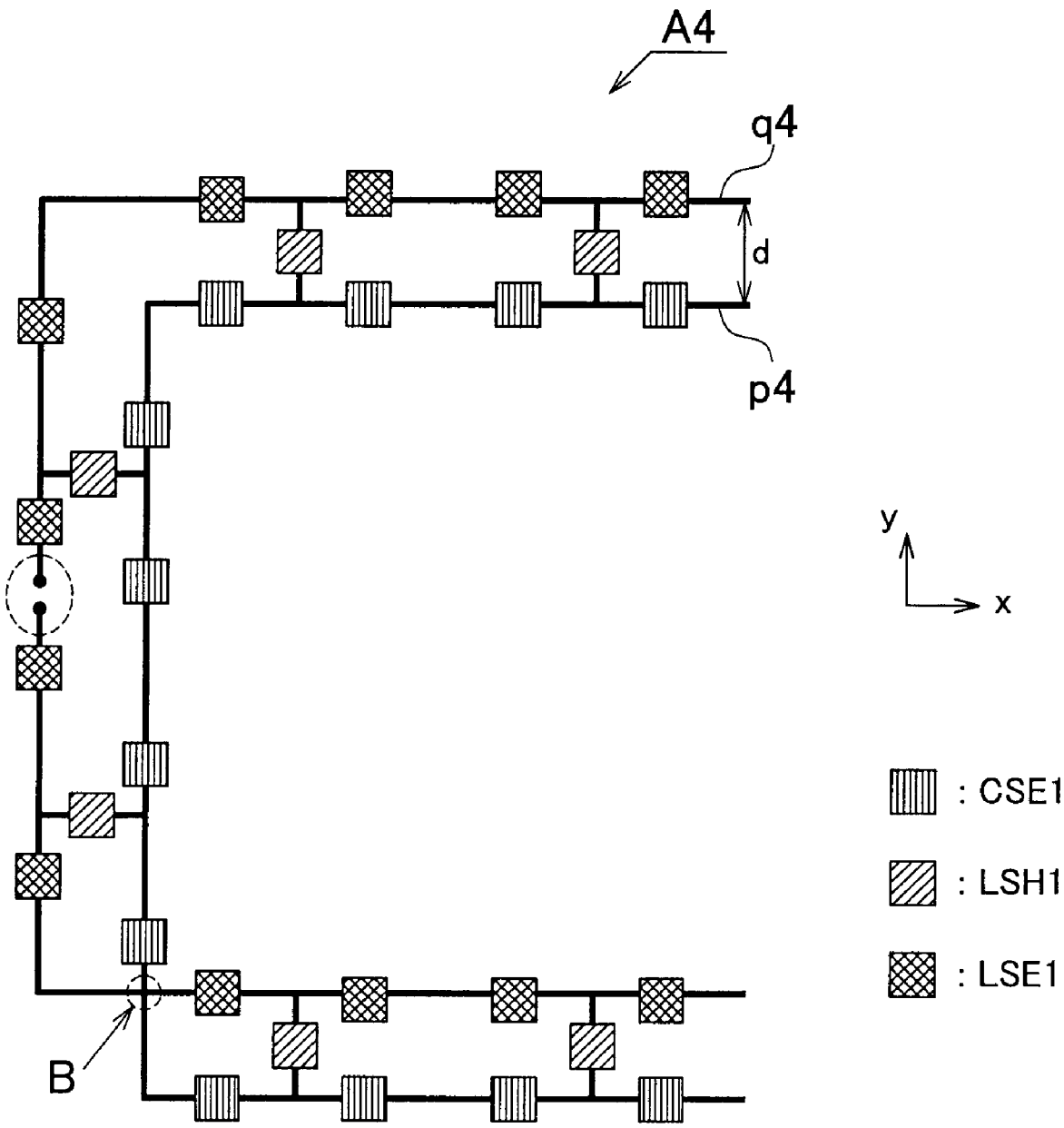
FIG. 13 is a plan view that shows the configuration of a dipole antenna in accordance with a sixth embodiment of the present invention.

In the configurations of FIGS. 6 and 13, a connection line 50 may be provided parallel to the base portion 10.

In the above embodiments, the base portion 10 may emit and receives radiation waves. That is, the base portion 10 may be formed in the polarization direction of waves to be transmitted when the dipole antenna functions as a transmission antenna, and may be formed in the polarization direction where waves are most efficiently received when the dipole antenna functions as a reception antenna. The extended portions 30, 31 may be bent at an angle of 90 degrees with respect to the base portion 10, and formed to be continuous with the base portion 10. However, the angle between the base portion and the extended portion is not limited to being 90 degrees. The extended portions may be formed to extend from both ends of the base portion not necessarily and strictly at an angle of 90 degrees and parallel to each other but in such a manner that they may be considered as equivalently parallel in terms of excitation.

The dipole antenna in accordance with the present invention is not restricted to one that is symmetric with respect to a line. In addition, the plurality of metal wires may be parallel to each other.

Similar unit circuits that may be used in the present invention may include circuits obtainable by a symmetric transformation with respect to a line, a point, a rotation, and so forth.

Unit circuits including a feed point or disposed at an end occasionally may have input/output boundary conditions different from those of other unit circuits. The similar unit circuits may also include unit circuits subjected to slight deformation or element volume adjustment to adjust their peculiar boundary conditions. The distance between the base portion and the connection line disposed parallel to the base portion and connected to the extended portions are preferably the length of a unit circuit or a half that. A combined use of capacitors in comb-shaped interdigital capacitor patterns and inductors in a meandering inductor pattern are preferable.

The present invention may be applied to antennas for use in other in-vehicle applications, such as smart entry systems or the like.

While example embodiments of the invention have been described above, it is to be understood that the invention is not limited to the particulars of the described embodiments, but may be embodied with various changes, modifications or improvements, which may occur to those skilled in the art, without departing from the scope of the invention.

What is claimed is:

1. A dipole antenna comprising:

a plurality of parallel metal wires as a basic structure, wherein the plurality of metal wires have a plurality of identical or similar unit circuits arranged in a row in an extending direction of the metal wires and connected with each other;

the unit circuits each have a tie portion that connects the metal wires with each other via at least one first inductor, and at least one first capacitor provided on at least one of the metal wires;

the plurality of metal wires each have a base portion and a pair of extended portions;

the extended portions extend at an angle of 90 degrees with respect to the base portion, and pass through a middle portion of each of the plurality of metal wires, the middle portion constituting the base portion;

the extended portions are symmetric with respect to a symmetric axis perpendicular to the middle portion of each of the plurality of the metal wires;

a ratio in length between the base portion and one of the extended portions is 1:n, where n is a positive integer; and resonance is achieved at least two frequencies.

2. The dipole antenna according to claim 1, wherein a continuing body composed of the base portion and the pair of extended portions has a squared U-shape.

3. The dipole antenna according to claim 1, wherein the symmetric axis is perpendicular to a plane constituted by portions of the plurality of metal wires, the portions constituting the base portions.

4. The dipole antenna according to claim 1, wherein the symmetric axis is positioned in a plane constituted by portions of the plurality of metal wires, the portions constituting the base portions.

5. The dipole antenna according to claim 1, wherein:

a substantial base portion, which is a region with a length equal to a half of a length of the base portion, stands on a ground conductor;

one of the extended portions is disposed parallel to the ground conductor;

the base portion is constituted by the substantial base portion and a mirror image of the substantial base portion; and the pair of the extended portions are constituted by the one extended portion and a mirror image of the one extended portion.

6. The dipole antenna according to claim 1, further comprising:

a connection line is composed of one of the unit circuits or the plurality of unit circuits, wherein the connection line is disposed parallel to the base portion and connected to the extended portion.

7. The dipole antenna according to claim 6, wherein:

a substantial base portion, which is a region with a length equal to a half of a length of the base portion, and a substantial connection line portion, which is a region with a length equal to a half of a length of the connection line stand on a ground conductor;

one of the extended portions is disposed parallel to the ground conductor;

the base portion is constituted by the substantial base portion and a mirror image of the substantial base portion;

the connection line is constituted by the substantial connection line portion and a mirror image of the substantial connection line portion; and the pair of the extended portions are constituted by the one extended portion and a mirror image of the one extended portion.

8. The dipole antenna according to claim 6, wherein a feed point is provided in the connection line.

9. The dipole antenna according to claim 1, wherein a feed point is provided in the base portion.

10. The dipole antenna according to claim 1, wherein:

the unit circuits are each an identical circuit; and the unit circuits are each arranged periodically in the direction of the metal wires and connected with each other.

11. The dipole antenna according to claim 1, wherein both ends of each of the plurality of metal wires are open.

12. The dipole antenna according to claim 1, wherein the unit circuits each have second inductors connected in series on a metal wire other than the metal wire on which the first capacitor is disposed.

13. The dipole antenna according to claim 1, wherein the tie portion of each of the unit circuits has a second capacitor connected in parallel with the first inductor.

14. The dipole antenna according to claim 1, wherein the first inductor is composed of a meandering inductor pattern.

15. The dipole antenna according to claim 1, wherein the first capacitor is composed of a comb-shaped interdigital capacitor pattern.

16. The dipole antenna according to claim 1, wherein each of the first capacitor and the first inductor is composed of a lumped element.

17. The dipole antenna according to claim 1, further comprising:

a flexible substrate on which conductor patterns are stacked, wherein the first inductor is composed of a meandering inductor pattern constituted by the conductor patterns; and the first capacitor is composed of a comb-shaped interdigital capacitor pattern constituted by the conductor patterns.

18. The dipole antenna according to claim 1, wherein a value of n is 1.

19. The dipole antenna according to claim 1, wherein the frequencies, at which the resonance is achieved, exist in a range of a 300 MHz band to a 400 MHz band.

* * * * *